US008085955B2

(12) United States Patent
Henry

(10) Patent No.: US 8,085,955 B2
(45) Date of Patent: Dec. 27, 2011

(54) ELECTROMAGNETIC LEVER DIAPHRAGM AUDIO TRANSDUCER

(76) Inventor: Todd Henry, Aurora, IL (US)

( * ) Notice: Subject to any disclaimer, the term of this patent is extended or adjusted under 35 U.S.C. 154(b) by 1471 days.

(21) Appl. No.: 11/363,007

(22) Filed: Feb. 27, 2006

(65) Prior Publication Data

US 2006/0198541 A1 Sep. 7, 2006

Related U.S. Application Data

(60) Provisional application No. 60/657,946, filed on Mar. 1, 2005.

(51) Int. Cl.
*H04R 25/00* (2006.01)

(52) U.S. Cl. ..... 381/152; 381/431; 381/423; 381/412; 381/399

(58) Field of Classification Search ..... 381/152, 381/412, 431, 423, 399
See application file for complete search history.

(56) References Cited

U.S. PATENT DOCUMENTS

| | | | | |
|---|---|---|---|---|
| 4,531,025 | A | 7/1985 | Danley et al. | |
| 4,547,631 | A | 10/1985 | Nieuwendijk et al. | |
| 4,763,358 | A | 8/1988 | Danley | |
| 5,103,482 | A | 4/1992 | Fabri-Conti | |
| 5,317,642 | A | 5/1994 | Danley et al. | |
| 5,526,456 | A | 6/1996 | Heinz | |
| 5,701,359 | A | 12/1997 | Guenther et al. | |
| 5,737,435 | A | 4/1998 | De Poortere et al. | |
| 6,411,718 | B1 | 6/2002 | Danley et al. | |
| 6,611,604 | B1 | 8/2003 | Irby et al. | |
| 7,134,523 | B2 | 11/2006 | Engelbretson | |
| 7,174,025 | B2 * | 2/2007 | Azima et al. | 381/152 |
| 7,302,068 | B2 | 11/2007 | Longbottom et al. | |
| 2002/0014369 | A1 | 2/2002 | Engebretson | |
| 2002/0106097 | A1 | 8/2002 | Danley et al. | |
| 2002/0114482 | A1 | 8/2002 | Adamson | |
| 2002/0146145 | A1 | 10/2002 | James et al. | |
| 2003/0081800 | A1 | 5/2003 | Klasco et al. | |
| 2005/0031151 | A1 | 2/2005 | Melillo | |
| 2005/0276427 | A1 | 12/2005 | Kam | |
| 2006/0169530 | A1 | 8/2006 | Noselli et al. | |
| 2007/0076915 | A1 | 4/2007 | Shin et al. | |
| 2007/0081687 | A1 | 4/2007 | Hayashi | |

FOREIGN PATENT DOCUMENTS

EP 1 439 731 7/2004

(Continued)

OTHER PUBLICATIONS

Japanese Patent Office, Office action in Japanese Patent Application No. 2007-558099, dated Feb. 10, 2011 (translation only).

(Continued)

*Primary Examiner* — Davetta W Goins
*Assistant Examiner* — Jasmine Pritchard
(74) *Attorney, Agent, or Firm* — McAndrews Held & Malloy, Ltd.

(57) ABSTRACT

A transducer including a frame and a panel disposed within the frame and coupled to the frame such that the panel may rotate relative to the frame about a rotational axis. The transducer includes an actuator positioned to engage the panel such that the panel rotates about the rotational axis.

41 Claims, 28 Drawing Sheets

FOREIGN PATENT DOCUMENTS

| | | |
|---|---|---|
| JP | 54-75126 | 5/1979 |
| JP | 61 144200 | 7/1986 |
| JP | 62-103397 | 7/1987 |
| JP | 2161895 | 6/1990 |
| JP | 2006-13671 | 12/2006 |
| WO | WO 2004/100605 | 11/2004 |

OTHER PUBLICATIONS

PCT Search Report for PCT App. No. US2006 / 006860, Aug. 14, 2006.
Office Action in U.S. Appl. No. 12/157,011, dated Sep. 1, 2011.
Office Action in U.S. Appl. No. 11/825,751, dated Jul. 12, 2011.

* cited by examiner

Prior Art

Prior Art

Prior Art

Prior Art

ELECTROMAGNETIC LEVER DIAPHRAGM AUDIO TRANSDUCER

RELATED APPLICATIONS

This application is related to, and claims priority from, Provisional Application No. 60/657,946, filed Mar. 1, 2005, titled "Electromagnetic Lever Diaphragm Audio Transducer," the complete subject matter of which is incorporated herein by reference in its entirety.

BACKGROUND OF THE INVENTION

The present invention relates generally to electromagnetic transducers such as those used in audio speaker systems, and more particularly to an electromagnetic audio transducer with a lever diaphragm.

An electromagnetic audio transducer is a device used to create sound in speaker systems. FIG. 1 illustrates a cross-section view of a conventional cone style electromagnetic audio transducer known as a speaker. The speaker 10 includes a round supporting frame or basket 14, a round conical diaphragm or cone 18, a conductive coil of wire known as a voice coil 22 that is wound around a former 26, and a round magnetic system 30. The magnetic system 30 includes a donut-shaped permanent magnet 38 with opposite poles positioned between top and bottom flux conducting plates 42 and 46. The speaker 10 further includes a flux conductive pole piece 50 that is either part of, or connected to, the bottom plate 46. The top plate 42 and pole piece 50 define a gap 34 therebetween. The gap 34 is a low permeability air gap in the flux path of a magnetic circuit. The pole piece 50 directs and concentrates magnetic flux 36 across the gap 34. The voice coil 22 and the former 26 are attached to the cone 18, and the cone 18 is suspended from the basket 14 by a flexible surround 51 and spider 54. The flexible surround 51 and spider 54 center the voice coil 22 in the gap 34 where the lines of magnetic flux are concentrated. The voice coil 22 is thus positioned to reciprocate specifically along an axis 40 perpendicular to the lines of magnetic flux 36 in the gap 34.

The electromagnetic audio transducer, speaker 10, is defined by the cone 18, voice coil 22, former 26, surround 51, spider 54, basket 14, and magnet system 30. An actuator comprised of a magnet system 30 and voice coil 22 define the driver of the electromagnetic audio transducer of speaker 10. In operation, the speaker 10 is mounted to an enclosure called a speaker box (not shown), and the electrically conductive voice coil 22 receives an alternating current from an audio amplifier (not shown). The electrically charged or energized voice coil 22 in turn produces a dynamic electromagnetic field that reacts with the magnetic flux 36 in the gap 34 to create a reciprocating axial driving force in the voice coil 22 such that the voice coil 22 moves up and down in the gap 34 along the axis 40 in the directions of arrows A and B. Thus, the voice coil 22, former 26, and cone 18 reciprocate as one unit relative to the speaker box displacing air to create pressure waves in air identified as sound waves.

It is common for a speaker box to have more than one speaker to form a speaker system such that the two or more speakers, each producing sound within a different range of frequencies, will be radiated away from the box completing a full range of sound in the audible sound spectrum. Most commonly, these individual speakers are known as high, mid, bass, and sub-bass. The speakers for the bass and sub-bass frequencies need to move excessively larger volumes of air to produce their low frequencies in order to maintain a sound pressure level (SPL) consistently matched with the mid and high frequency speakers.

One way to displace larger volumes of air is to increase the axial movement of the cone 18. However, the axial movement of the cone 18 is mechanically limited by the suspension system of the surround 51 and spider 54 and by the limited range of movement of the voice coil 22 within the driver. The cone 18 of the speaker 10 will move to maintain a consistent SPL with the higher frequency speakers in the speaker system up to the point where one of the mechanical limitations has been reached. However, any axial movement beyond this point will result in a decline in sound quality. The decline in sound quality is known as distortion. Distortion occurs when sound output from the speaker 10 does not identically correspond to the electrical input signal to the speaker and results in poor sound quality. Furthermore, a decline or "rolling off" of the sound pressure level occurs below this point because the cone 18 is fixed in size and cannot displace the increased volume of air required by the lower frequencies.

Another problem with conventional audio speakers is that they are not efficient. Efficiency is expressed in terms of watts and is a percentage that is derived from the ratio of electrical input power applied to the speaker to the acoustical power output transmitted from the speaker. The typical efficiencies of modern audio speakers are in the range of only a few percent. Most of the electrical output from an audio amplifier is wasted by the speaker and dissipated off in the form of heat, not sound. Thus, speaker inefficiency can be very expensive and is a significant consideration in speaker design.

The speaker 10 of FIG. 1 has an "underhung" voice coil geometry where the voice coil 22 is shorter than the depth of the gap 34. The underhung voice coil 22 is not receiving an electrical input signal and thus is illustrated at its rest position. When a positive electrical input signal is applied to a positive terminal (not shown) on the speaker 10, the voice coil 22 and cone 18 move in the direction of arrow B toward a position of "cone extension." Conversely, when a negative electrical input signal is applied to the same terminal on the speaker 10, the voice coil 22 and the cone 18 move in the direction of arrow A toward a position of "cone retraction." FIG. 2 illustrates the speaker 10 of FIG. 1 where the cone 18 and voice coil 22 have moved to a position of cone extension. At this position, the voice coil 22 reaches an outer edge 33 of the gap 34, which is known as the maximum linear excursion ("Xmax") position of the voice coil 22. When the cone 18 moves in the opposite direction to the cone retraction position, the voice coil 22 reaches an inner edge of the gap 34 and is in an opposite Xmax position. The full range of motion traveled by the voice coil 22 from an extended Xmax to a retracted Xmax is known as the speakers Xmax peak-to-peak parameter. When the voice coil 22 of the speaker 10 is not energized as illustrated in FIG. 1, the suspension system (the surround 51 and spider 54) will return the coil 22 to its rest position midway between the Xmax peaks. When the voice coil 22 is energized at sufficient energy levels and particularly at low frequencies, it will reciprocate past the Xmax peak-to-peak positions, temporarily moving and operating partially out of the gap 34. The voice coil 22 is then no longer moving linearly with the electrical input signal because a portion of the voice coil 22 is not within the gap 34 and not reacting with the magnetic field and thus the output sound signal will be distorted. The efficiency of the speaker 10 will also be reduced when the voice coil 22 operates beyond its Xmax positions because the electrical input power is not producing as much force and is dissipated as heat when the voice coil 22 is outside the gap 34.

The underhung voice coil geometry of speaker 10 maintains low distortion when operated within its Xmax range. The speaker 10 is relatively efficient as long as the voice coil 22 is operated within the Xmax range and thus within the magnetic field in the gap 34. The underhung speaker 10, however, is easily driven to operate beyond the Xmax by trying to produce very low frequencies or by over-powering the voice coil 22 to produce higher sound intensity levels. Over powering will not only cause the voice coil 22 to be driven beyond its Xmax range and distort the sound, it will also cause the voice coil 22 of the speaker 10 to quickly reach its thermal limit and overheat. Thus, the underhung voice coil geometry of speaker 10 in FIG. 1 is not able to produce undistorted high sound intensity levels at a lower frequency range and is better suited for higher efficiencies and lower distortion at the upper ranges of its bass frequencies.

The underhung voice coil geometry of speaker 10 of FIG. 1 can be modified to produce higher sound intensity levels at lower frequencies by using a larger top plate 42 and a correspondingly taller pole piece 50 to define a deeper gap 34 in which the voice coil 22 may travel further before reaching Xmax peak-to-peak. However, this "highly underhung" voice coil geometry can be less efficient than a standard underhung arrangement because the flux 36 (FIG. 1) in the gap 34 will not be as strongly concentrated due to the increase in surface area of the top plate 42.

FIG. 3 illustrates another conventional speaker 10*a* designed to overcome some of the drawbacks of the underhung speaker 10 (FIG. 1). The speaker 10*a* has an "overhung" voice coil geometry that extends out beyond the gap 34*a* from both ends when the voice coil 22*a* is at rest. The top plate 42*a*, and thus the gap 34*a*, is thin like that found in the underhung speaker 10 of FIG. 1 so that the flux 36*a* density is highly concentrated. As with the speaker 10 of FIG. 1, the speaker 10*a* moves in the direction of arrow B to cone extension or in the direction of arrow A to cone retraction depending on the polarity of the electrical input signal.

FIG. 4 illustrates the speaker 10*a* of FIG. 3 where the cone 18*a* has moved to the cone extension position and the voice coil 22*a* has moved to an Xmax in the direction of arrow B from the rest position. At this Xmax position, an inner edge of the voice coil 22*a* reaches an inner edge of the gap 34*a*. When the cone 18*a* moves in the opposite direction to the cone retraction position, the voice coil 22*a* moves in the direction of arrow A to an Xmax position past the rest position to where an outer edge of the voice coil 22*a* reaches an outer edge of the gap 34*a*. The voice coil 22*a* can move further along the axis 40*a* than can the underhung voice coil 22 in speaker 10 of FIG. 1 and thus produce a higher SPL at lower frequencies before distortion occurs. The larger voice coil 22*a* can also handle larger amounts of power. However, the voice coil 22*a* can be less efficient because a portion of the voice coil 22*a* is always operating outside of the gap 34*a* and thus wasting power. Furthermore, the larger size and mass of the voice coil 22*a* increases the opposing inertial forces acting on it such that the cone 18*a* cannot move as efficiently or fast to produce the higher frequencies as it could with the smaller voice coil 22 of the underhung speaker 10 (FIG. 1). Thus, a reduction in the efficiency in the upper range of bass frequencies may occur.

Conventional cone style speakers have another drawback when multiple speakers, each producing a different range of frequencies, are combined together within a single controlled space, such as a horn, to create a full range speaker system. Examples of such speaker systems are disclosed in U.S. Pat. Nos. 5,526,456 and 6,411,718. Because of the irregular shape of their conical diaphragms (the speaker cone), the low and mid frequency transducers in this type of speaker system positioned in the walls of the horn disrupt the paths of the higher frequencies produced by the high frequency transducers near the apex of the horn. In order to prevent the conical diaphragms from disrupting the paths of the higher frequencies, special adapters and apertures are added to the horn to maintain the continuity of the horn wall. Also, the round periphery of a conical diaphragm does not maximize use of the available horn wall area upon which it is mounted and thus wastes useful horn wall space.

Therefore, a need exists for a transducer for use in an audio speaker system that is capable of producing high sound intensity levels while maintaining high electrical efficiencies and low distortion and that may be combined with other audio transducers in a speaker system such that it can provide continuity in the wall of a horn and a low disruptive path for the sound waves emitted by the other audio transducers within the speaker system.

BRIEF SUMMARY OF THE INVENTION

Certain embodiments of the present invention include a transducer. The transducer includes a frame and a panel disposed within the frame and coupled to the frame such that the panel may rotate relative to the frame about a rotational axis. The transducer includes an actuator positioned to engage the panel such that the panel rotates about the rotational axis to displace air.

Certain embodiments of the present invention include an electromagnetic transducer having a frame and a panel disposed within the frame and coupled to the frame such that the panel may rotate relative to the frame about a rotational axis at the coupling between the panel and the frame. The transducer includes a conductive coil coupled to the panel and a magnetic structure coupled to the frame. The magnetic structure includes a gap in which a magnetic field is provided, and the gap is positioned to receive the conductive coil. The conductive coil is electrically charged within the gap to move such that the panel rotates about the rotational axis to displace air.

Certain embodiments of the present invention include a speaker system. The speaker system includes an enclosure, a frame mounted to the enclosure, and a panel disposed within the frame and coupled to the frame such that the panel may rotate relative to the frame about a rotational axis at the coupling between the panel and the frame. The panel has an inner side facing toward the enclosure and an outer side facing out from the enclosure. The speaker system includes a conductive coil coupled to the panel and a magnetic structure connected to the frame. The magnetic structure includes a gap in which a magnetic field is provided. The gap is positioned to receive the conductive coil. The conductive coil is electrically charged within the gap to move such that the panel rotates about the rotational axis and the inner face displaces air within the enclosure and the outer face displaces air outside of the enclosure such that sound waves are formed.

Certain embodiments of the present invention include a speaker system. The speaker system includes a horn having walls defining a flared section from a throat to a mouth and at least one electromagnetic audio transducer disposed along one of the walls of the horn. The at least one electromagnetic audio transducer includes a frame, a trapezoidal-shaped panel disposed within the frame and having an inner face and an outer face, a conductive coil coupled to the inner face, and a magnetic structure connected to the frame. The conductive coil is electrically charged relative to the magnetic structure such that the trapezoidal-shaped panel moves relative to the frame to produce sound waves within the horn.

Certain embodiments of the present invention include a speaker. The speaker includes a baffle and a panel disposed within the baffle and coupled to the baffle such that the panel may rotate relative to the baffle about a rotational axis. The speaker includes an actuator positioned to engage the panel such that the panel rotates about the rotational axis to displace air.

Figure 1:
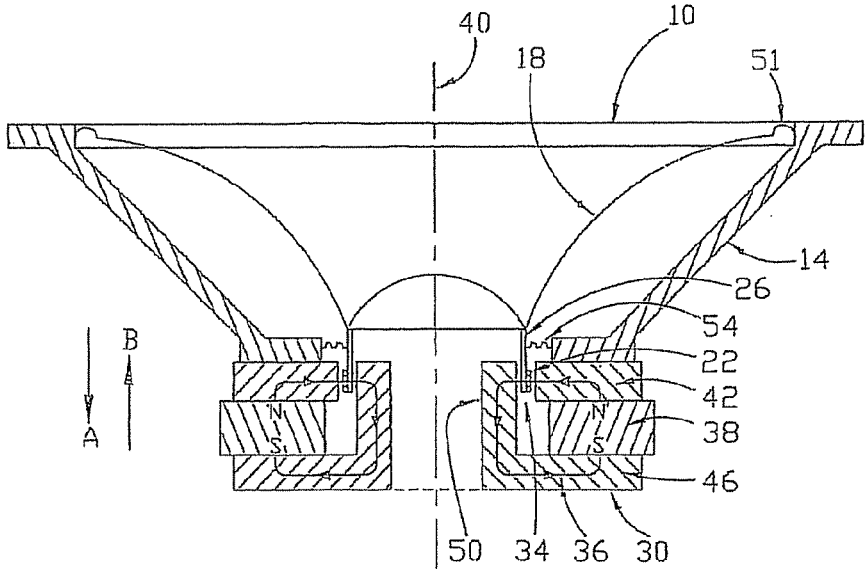
FIG. 1 illustrates a cross-sectional view of a prior art speaker.
Figure 2:
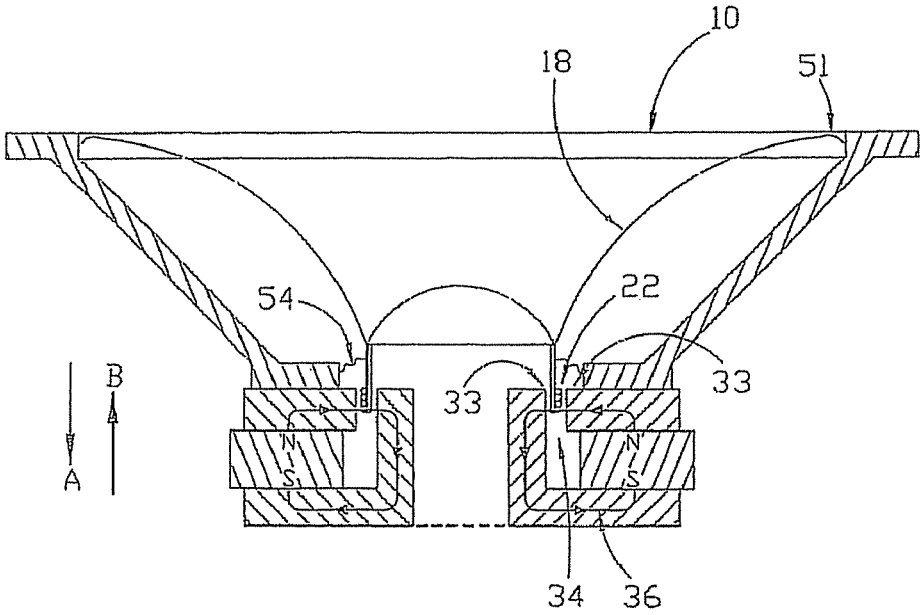
FIG. 2 illustrates the speaker of FIG. 1 in a cone extension position.
Figure 3:
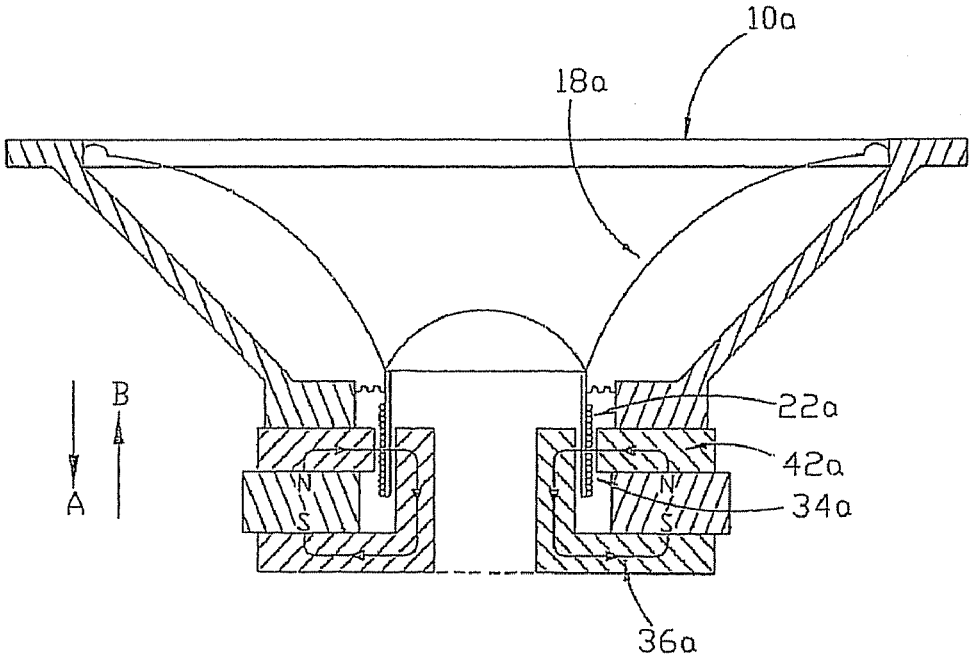
FIG. 3 illustrates a cross-sectional view of a prior art speaker.
Figure 4:
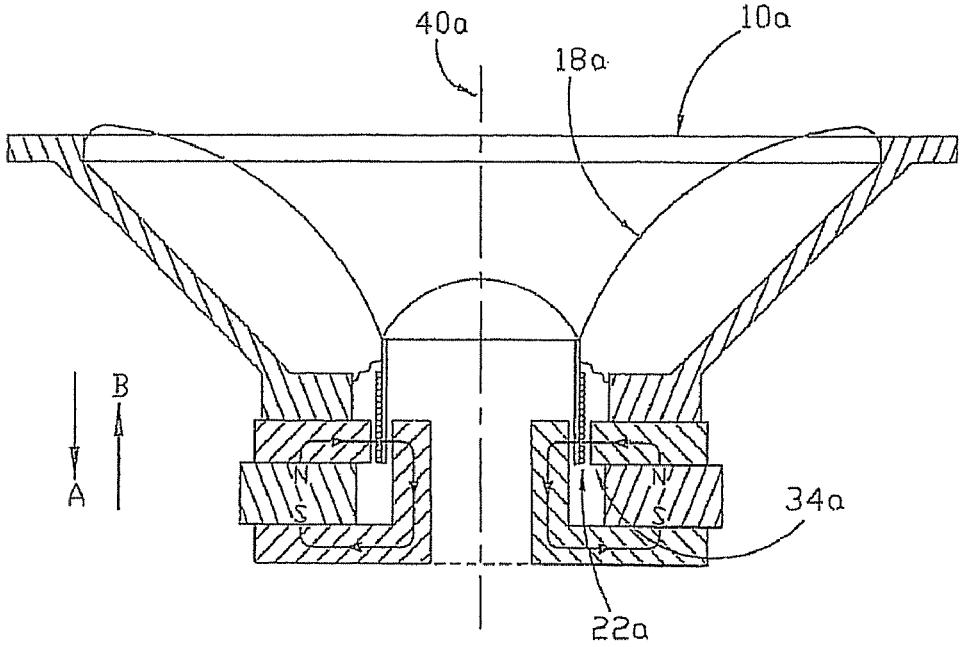
FIG. 4 illustrates the speaker of FIG. 3 in a cone extension position.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 5:
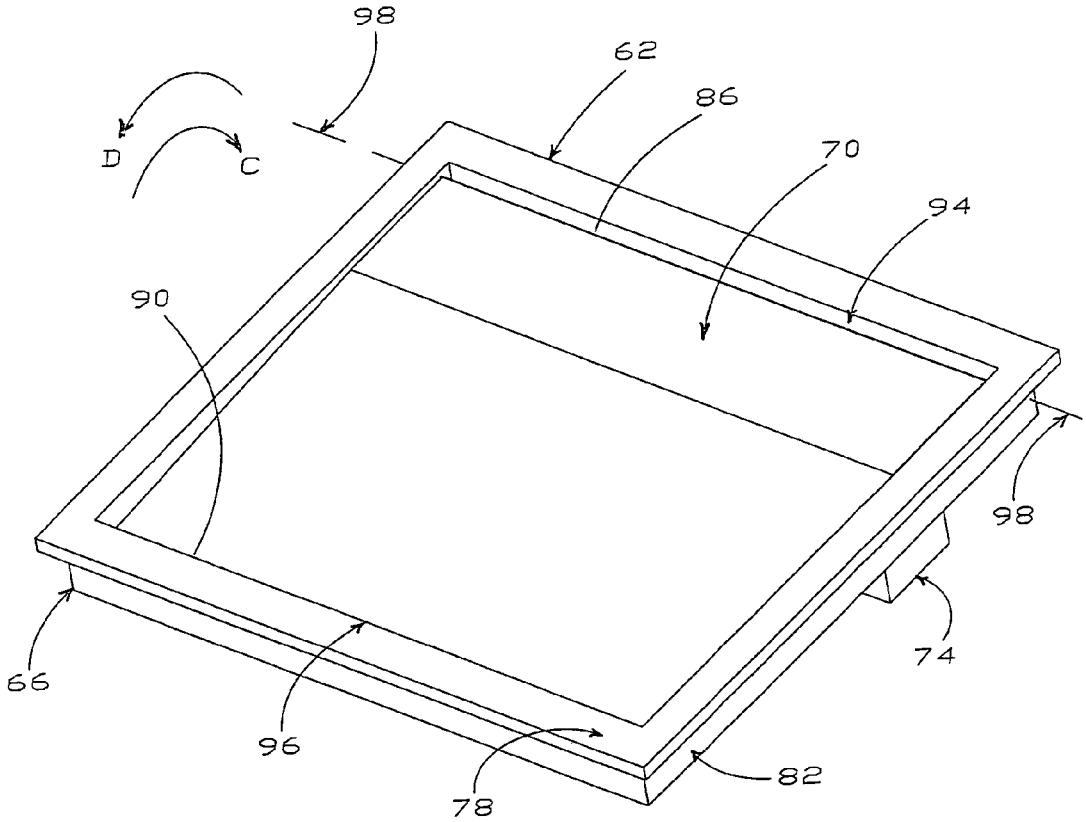
FIG. 5 illustrates a front isometric view of an electromagnetic audio transducer formed according to an embodiment of the present invention.

FIG. 5 illustrates a front isometric view of an electromagnetic audio transducer 62. The transducer 62 includes a frame 66, a panel or diaphragm 70, and a magnet box 74. The frame 66 is an enclosed, generally square shape with a face 78 formed integrally with a side wall 82. The frame 66 may be made of any number of rigid materials and, by way of example only, is made of metal and specifically aluminum. The panel 70 is generally planar and may be made of any number of rigid, lightweight materials. By way of example only the panel 70 may be made of a rigid foam. The panel 70 has a pivot end 86 and a tip end 90. The panel 70 may have grooves or a honeycombed structure or any other means to reduce mass and maintain its rigidity. The pivot end 86 of the panel 70 is connected to a first side 94 of the frame 66 such that the panel 70 can pivot about a rotational axis 98 in the directions of either arrows C or D. The tip end 90 of the panel 70 is free to move proximate a second side 96 of the frame 66. The pivot end 86 may be connected to the first side 94 of the frame 66 by any number of methods that allow the pivoting motion.

Figure 6:
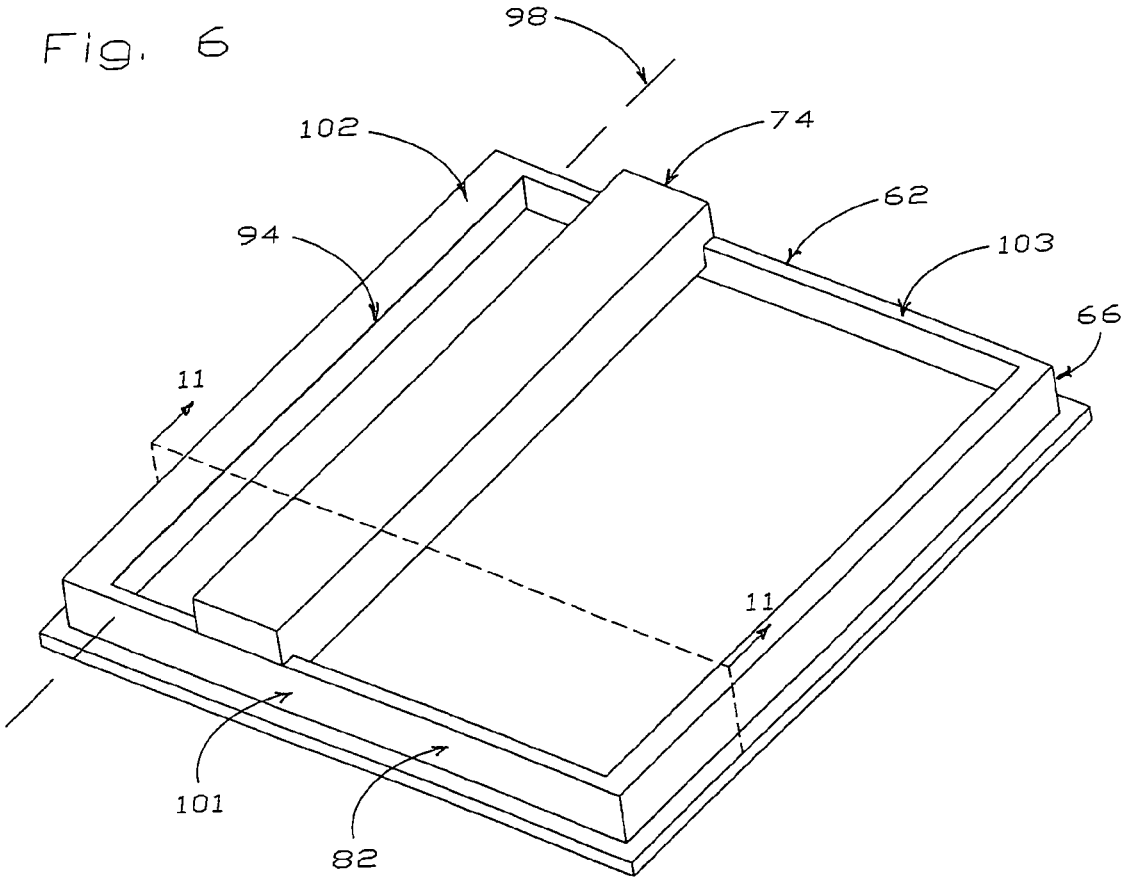
FIG. 6 illustrates a bottom isometric view of the electromagnetic audio transducer of FIG. 5.

FIG. 6 illustrates a bottom isometric view of the electromagnetic audio transducer 62 of FIG. 5. The magnet box 74 is a hollowed block shaped member that contains an array of magnets and that is mounted on a back side 102 of the frame 66 to opposite first and second members 101 and 103 of the side wall 82. The magnet box 74 may be detachably mounted on the back side 102 of the frame 66 along the side wall 82 at any number of distances from the first side 94 of the frame 66 generally parallel to the rotational axis 98.

Figure 7:
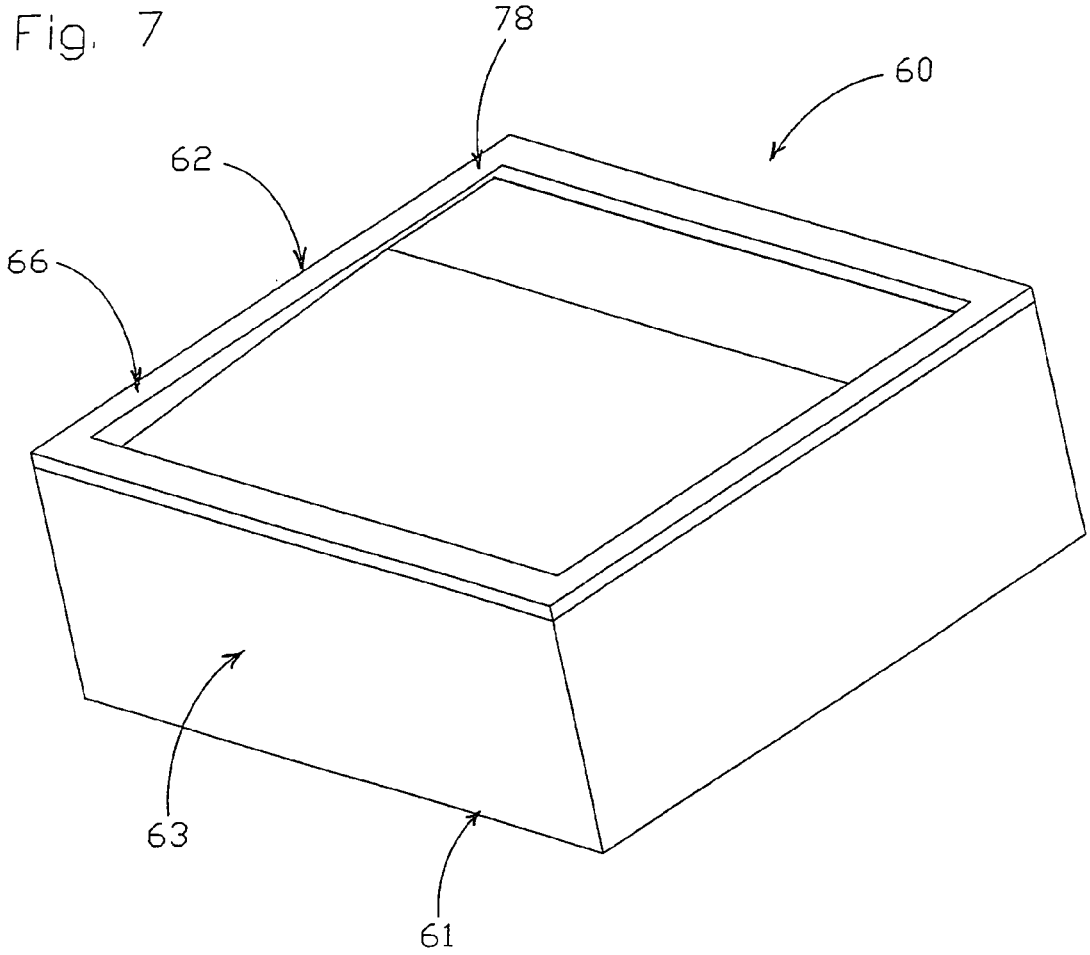
FIG. 7 illustrates a front isometric view of a speaker system formed according to an embodiment of the present invention.

FIG. 7 illustrates a front isometric view of a speaker system 60. The speaker system 60 includes the electromagnetic audio transducer 62 mounted to a speaker box 61 such that the speaker box 61 encloses one side of the transducer 62. The speaker box 61 may also be referred to as an enclosure. The side wall 82 (FIG. 5) of the frame 66 is received within an aperture of the speaker box 61 and the face 78 fits on an exterior wall 63 of, and faces out from, the speaker box 61. It will be understood that the electromagnetic audio transducer 62 and its components and the speaker box 61 may take on any number of different sizes, shapes, or configurations according to the intended use and design of the speaker system.

Figure 8:
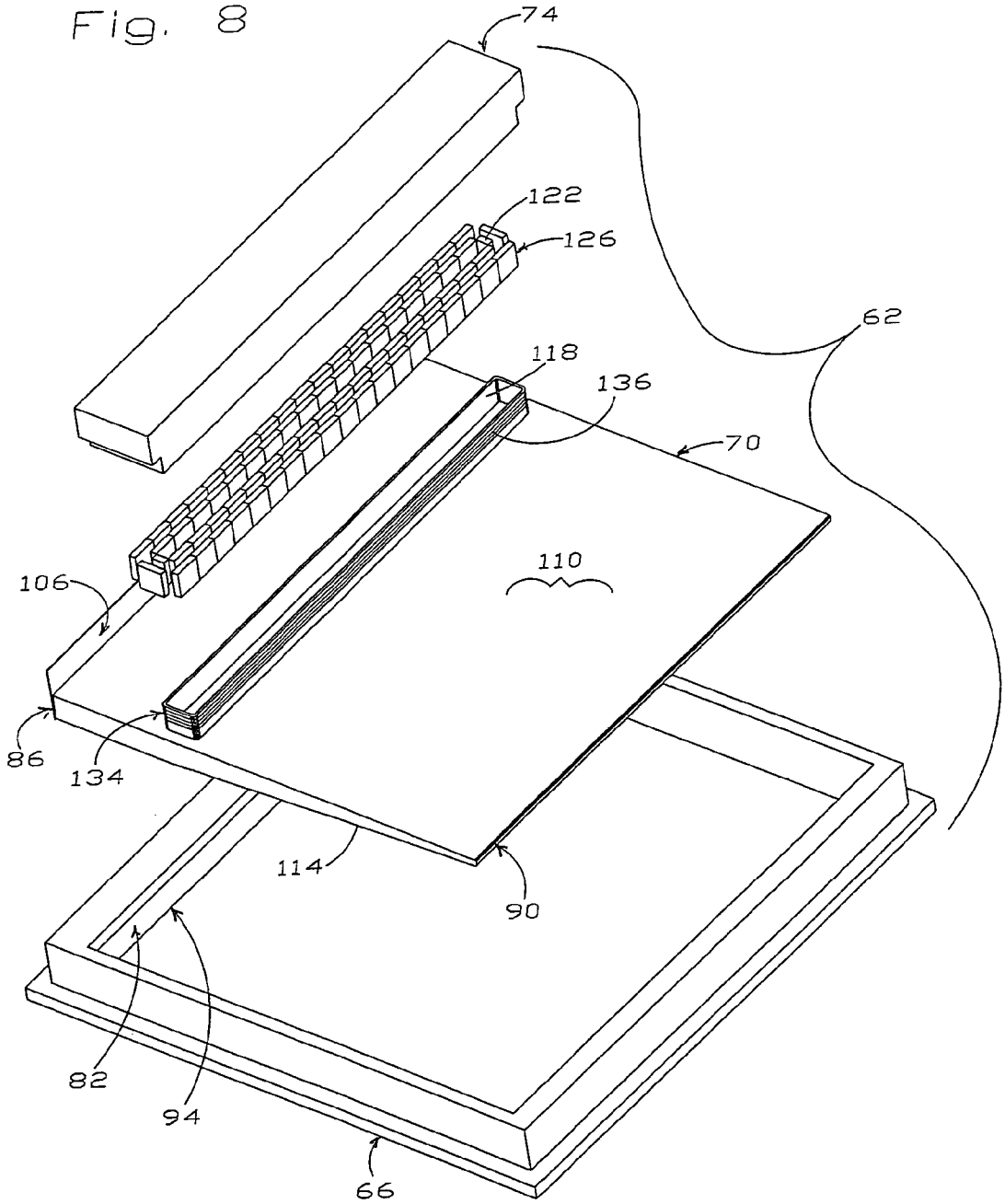
FIG. 8 illustrates an exploded isometric view of the electromagnetic audio transducer of FIG. 6.

FIG. 8 illustrates an exploded isometric view of the electromagnetic audio transducer 62 of FIG. 6. The panel 70 has an inner side 110 and an outer side 114. The outer side 114 gradually angles toward the inner side 110 such that the panel tapers down in thickness from the pivot end 86 to the tip end 90. Alternatively, the panel 70 may have any number of other shapes besides the tapered one shown. By way of example only, the panel 70 may be completely flat with a constant thickness, or may be wedge-shaped, or may have a curved and/or tapering inner or outer side 110 or 114 with a straight opposite side, or may be angled on one of, or both, the inner and outer sides 110 and 114, or may be curved on both the inner and outer sides 110 and 114, or may have any combination of shapes, angles, tapers, or curves. The panel 70 is connected to a thin sheet 106 of metal such as spring steel. Alternatively, the sheet 106 may be made of any number of flexible materials. The panel 70 may be connected to the sheet 106 by glue, epoxy, or any number of other methods.

When the panel 70 is assembled to the frame 66, the thin sheet 106 is connected to the side wall 82 at the first side 94 of the frame 66 by bolting, clamping, pinning, or any number of other methods of fastening such that the panel 70 is able to pivot proximate the first side 94. Alternatively, the panel 70 may be coupled to the frame 66 at the first side 94 or at the side members 101 and 103 (FIG. 6) or in any combination thereof by an axle, or hinge, or bushing, or bearing, or any other means such that the panel 70 is able to rotate about an axis relative to the frame 66. The transducer 62 may include a spring, elastic material, or magnetic system, or any other means to maintain the panel 70 in a centered position within the frame 66. The panel 70 includes a long rectangular-shaped former 118 attached to the inner side 110. The former 118 may be made of any number of rigid, light-weight, and heat resistant materials. A series of electrically conductive turns of wire 136 are wrapped around the former 118 to form a conductive voice coil 134 that is coupled to the panel 70 by way of the former 118. The magnet box 74 receives therein a magnetic structure including a magnet providing a magnetic field. For example, the magnetic structure includes an inner magnet group 122 and an outer magnet group 126.

Figure 9:
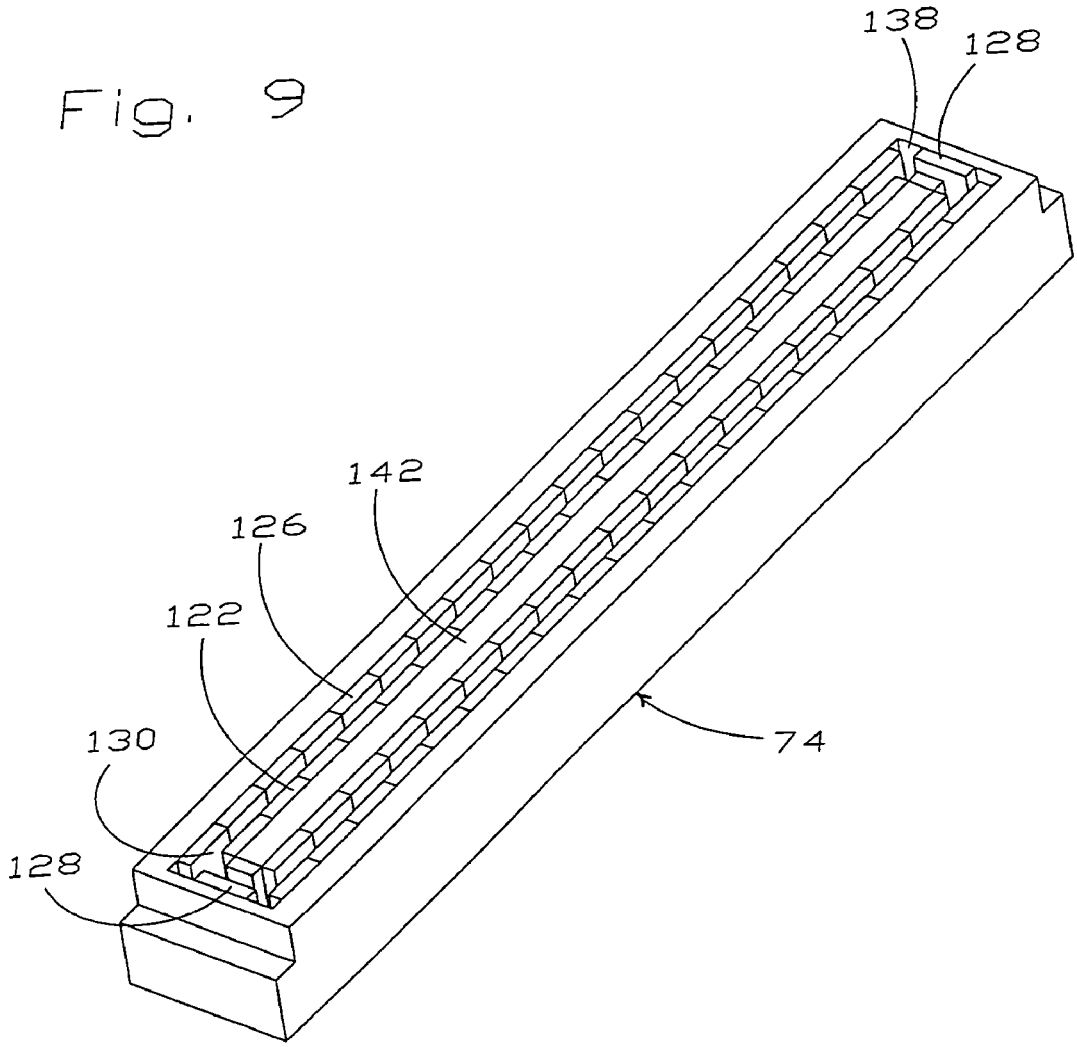
FIG. 9 illustrates a bottom view of the magnet box of FIG. 6.

FIG. 9 illustrates a bottom view of the magnet box 74 containing the inner and outer magnet groups 122 and 126. The outer magnet group 126 is positioned along an inner wall 138 of the magnet box 74 and the inner magnet group 122 is positioned along a center wall 142 of the magnet box 74. The inner and outer magnet groups 122 and 126 may be connected to the inner wall 138 and center wall 142, respectively, by any number of methods, for example, by glue or epoxy. The inner and outer magnet groups 122 and 126 define a gap 130 therebetween. A magnetic field is provided within the gap 130 by the magnetic structure through the opposing-polarity inner and outer magnet groups 122 and 126, which are also positioned along short sides 128 of the magnet box 74.

Returning to FIG. 6, when the electromagnetic audio transducer 62 is assembled, the magnet box 74 contains the inner and outer magnet groups 122 and 126 (FIG. 9) and is mounted on the frame 66 to receive the former 118 (FIG. 8) and the voice coil 134 (FIG. 8) within the gap 130 (FIG. 9) between the inner and outer magnet groups 122 and 126. The magnet box 74 and the voice coil 134 define the driver or actuator of the transducer 62. Not shown in FIG. 6 are the electric terminal connectors with wire leads providing continuity between the terminal connectors and the voice coil. These connectors are used to provide a point of electrical input to the voice coil from an amplifier, which is also not shown. It will be understood that the connectors and amplifier can be adapted for use in the embodiments herein.

Figure 10:
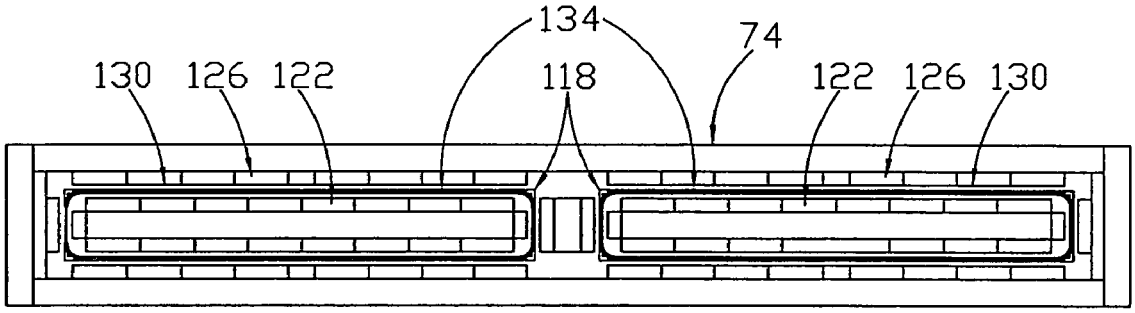
FIG. 10 illustrates a bottom view of a magnet box receiving a voice coil formed according to an embodiment of the invention.

Alternatively, the magnet box 74 and inner and outer magnet groups 122 and 126 may have different shapes to define a differently shaped gap 130 that corresponds to a differently shaped voice coil 134. For example, referring to FIG. 10, the single long rectangular former 118 and voice coil 134 of FIG. 8 may be divided into a plurality of shorter formers 118 and voice coils 134 that are received within a correspondingly arranged magnet box 74 with the inner and outer magnet groups 122 and 126 arranged to define gaps 130 to receive the voice coils 134. Alternatively, the formers 118 and voice coils 134 may have different shapes, such as square, cylindrical, or even a flat over-under vertically wound and positioned voice coil that may be received in correspondingly shaped magnet boxes 74 and gaps 130.

Figure 11:
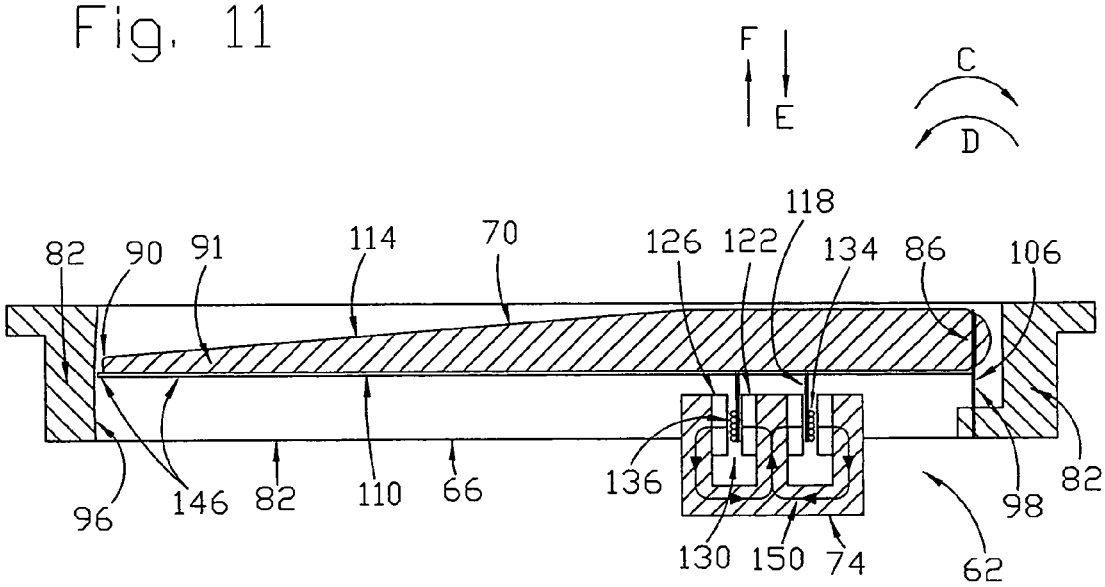
FIG. 11 illustrates a cross-sectional side view of the electromagnetic audio transducer of FIG. 6 taken along line 11-11.

FIG. 11 illustrates a cross-sectional side view of the electromagnetic audio transducer 62 of FIG. 6 taken along line 11-11. The second side 96 of the side walls 82 of the frame 66 is curved to accommodate the radial movement of the tip end 90 of the panel 70 and to maintain a generally constant distance between the tip end 90 and the second side 96 of the frame 66. The tip end 90 and its two adjacent side ends 91 of the panel 70 include a seal 146 on the inner side 110 that extends toward the side walls 82 but does not engage the side walls 82. The seal 146 is a low friction, light-weight, and flexible material that aids in sealing the inner side 110 of the panel 70 from the outer side 114 without engaging the side walls 82 of frame 66 to create friction. If the seal does contact the side wall 82, the low frictional seal material allows the panel to slide along the walls 82 with little resistance. Alternatively, the seal 146 may be located on the outer side 114 of the panel 70 or on both the inner and outer sides 110 and 114 of the panel 70. When the panel 70 is in the rest position as shown, the wire turns 136 of the voice coil 134 are positioned within the gap 130 of the magnet box 74.

In operation, the electromagnetic audio transducer 62 of FIG. 11 is positioned in the speaker box 61 (FIG. 7) such that the speaker box 61 pneumatically isolates the inner side 110 of the panel 70 from the outer side 114 of panel 70. The voice coil 134 is connected to an audio amplifier (not shown) that provides an alternating current electrical input signal to the voice coil 134 such that the voice coil 134 creates an alternating electromagnetic field. The alternating electromagnetic field reacts with a magnetic flux 150 provided in the gap 130 by the inner and outer magnet groups 122 and 126 such that the voice coil 134 moves within the gap 130 generally in the directions of arrows E and F. The movement of the voice coil 134 in the directions of arrows E and F in turn applies reciprocating torque forces to the panel 70 through the former 118 such that the panel 70 rotates at the pivot end 86 about the rotational axis 98 along the sheet 106 in the directions of arrows D and C, respectively. The tip end 90 of panel 70 thereby moves in a radial path about the rotational axis and within the confines of the frame 66. The conductive voice coil moves in a radial path about the rotational axis within the gap 130 of the magnet box 74. As the panel 70 moves within the frame 66 and the speaker box 61 (FIG. 7), the panel 70 creates pressure waves in the air. As the inner side 110 of the panel 70 produces a positive pressure wave, the outer side 114 of the panel 70 produces a negative pressure wave. Because the air pressure produced by the inner side 110 of the panel 70 is received in the speaker box 61, the air pressure waves produced by the outer side 114 of the panel 70 are emitted into the surrounding air outside of the speaker box 61. The displacement of air at a frequency corresponding to the input electrical signal from the audio amplifier creates sound waves.

Additionally, the transducer 62 is not limited to use with a driver or actuator that includes the magnet box 74 and voice coil 134 to move the panel 70. Rather, the panel 70 can be moved to rotate relative to the frame 66 by any machine, or driver, that transmits motion or power to the panel 70. Alternatively, the thin flexible strip 106 in FIG. 11 (shown positioned and attached perpendicular to panel to 70 and parallel to side wall 82) may be rotated 90 degrees and attached parallel to the panel 70 on the inner side 110 or the outer side 114 and perpendicularly attached to the side wall 82.

Figure 12:
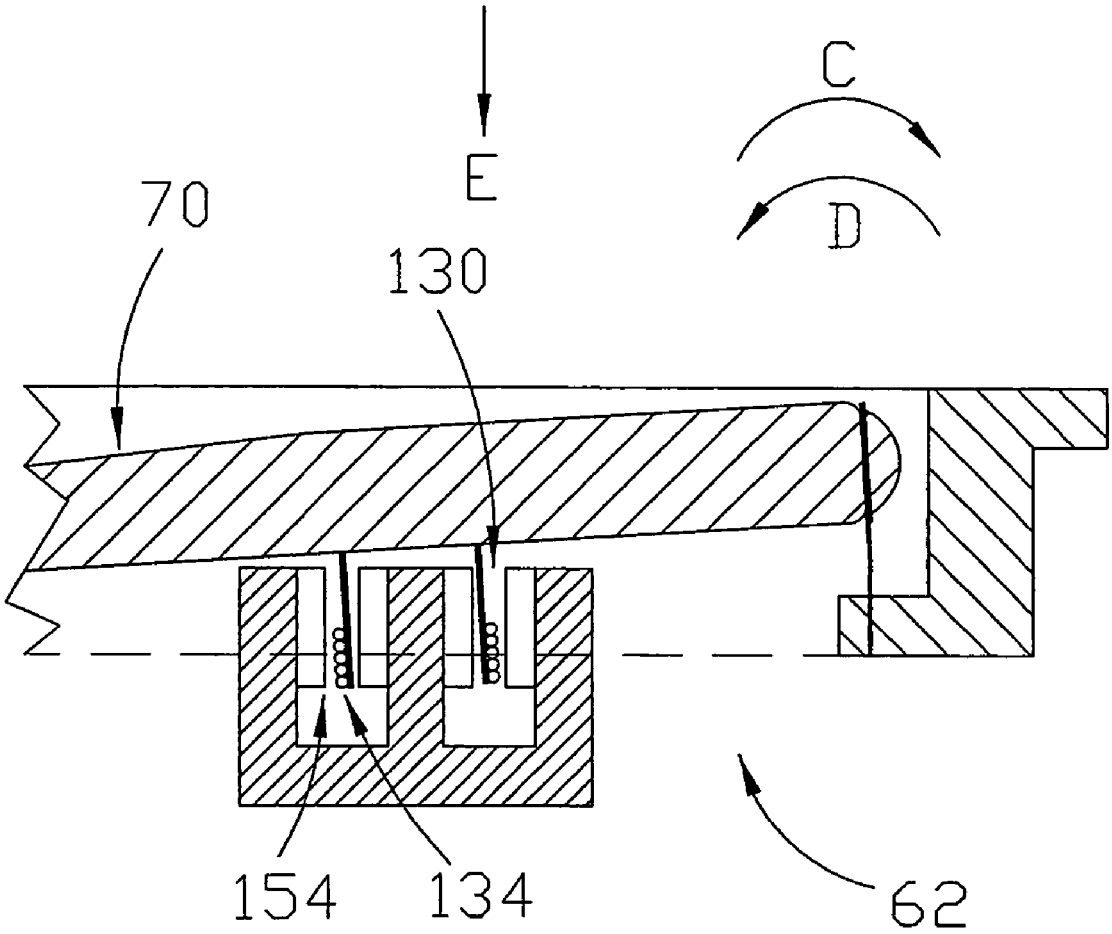
FIG. 12 illustrates a partial side view of the electromagnetic audio transducer of FIG. 11.

FIG. 12 illustrates a partial cross-sectional side view of the electromagnetic audio transducer 62 of FIG. 11. An electrical input signal drives the voice coil 134 in the direction of arrow E to a peak position at an outer edge 154 of the gap 130 but still within the gap 130. The voice coil 134 is in a first Xmax position. As the voice coil 134 moves in the direction of arrow E to its Xmax position, the panel 70 rotates in the direction of arrow D from the rest position of FIG. 11 to a diaphragm retraction position. Also, the tip end 90 (FIG. 11) of the panel 70 similarly moves to a maximum retracted position that is still within the confines of the frame 66 (FIG. 11). When the electrical signal changes direction, the voice coil 134 and the panel 70 then rotate in the direction of arrow C.

Figure 13:
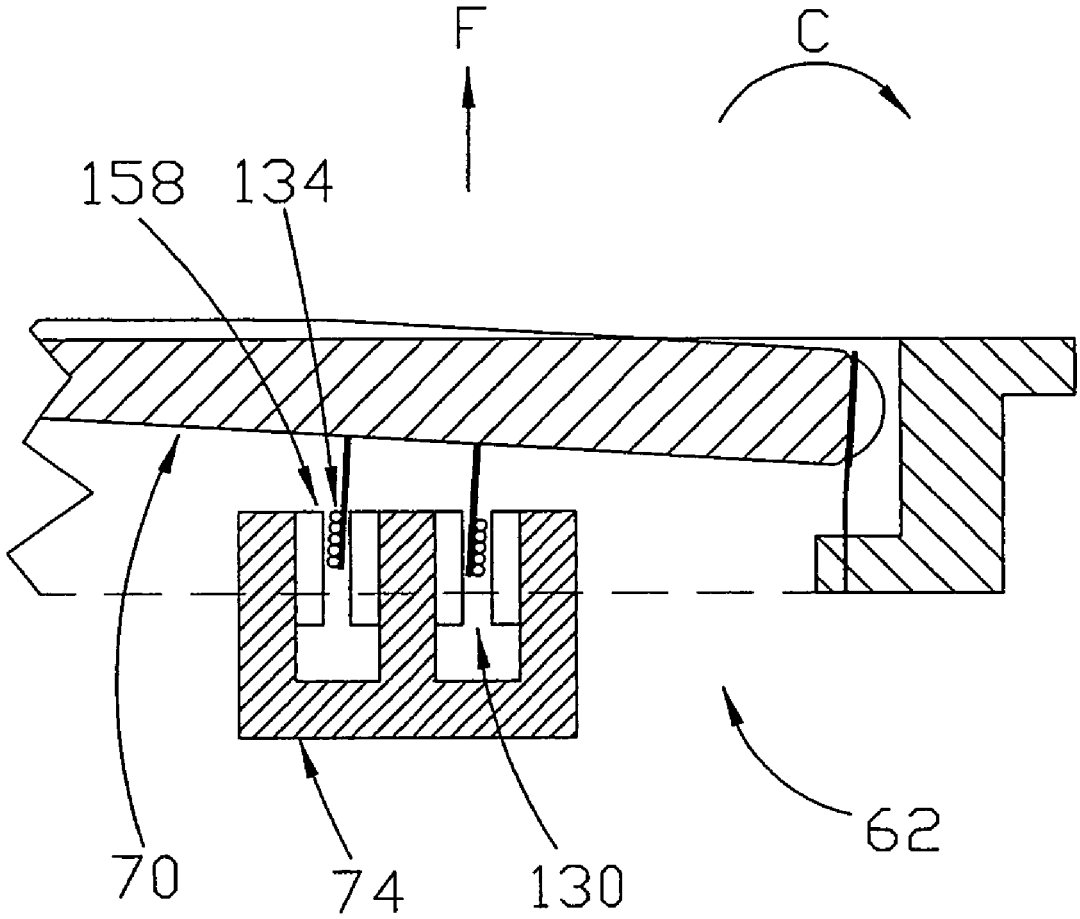
FIG. 13 illustrates a partial side view of the electromagnetic audio transducer of FIG. 11.

FIG. 13 illustrates a partial cross-sectional side view of the electromagnetic audio transducer 62 of FIG. 11. An electrical input signal drives the voice coil 134 in the direction of arrow F to a peak position at an inner edge 158 of the gap 130 but still within the gap 130. The voice coil 134 is in a second Xmax position. As the voice coil 134 moves in the direction of arrow F to its Xmax position, the panel 70 rotates in the direction of arrow C to a diaphragm extension position. Also, the tip end 90 (FIG. 11) of the panel 70 similarly moves to a maximum extension position that is within the confines of the frame 66 (FIG. 11). The magnet box 74 is positioned in relation to the panel 70 such that the voice coil 134 stays positioned within the gap 130 as the panel 70 moves across its full range of motion between the diaphragm retraction position and the diaphragm extension position. Because the voice coil 134 remains in the gap 130, the transducer 62 maintains a higher speaker efficiency and lower distortion while being able to produce greater air displacements resulting in higher sound pressure levels, especially at lower frequency ranges.

Figure 14:
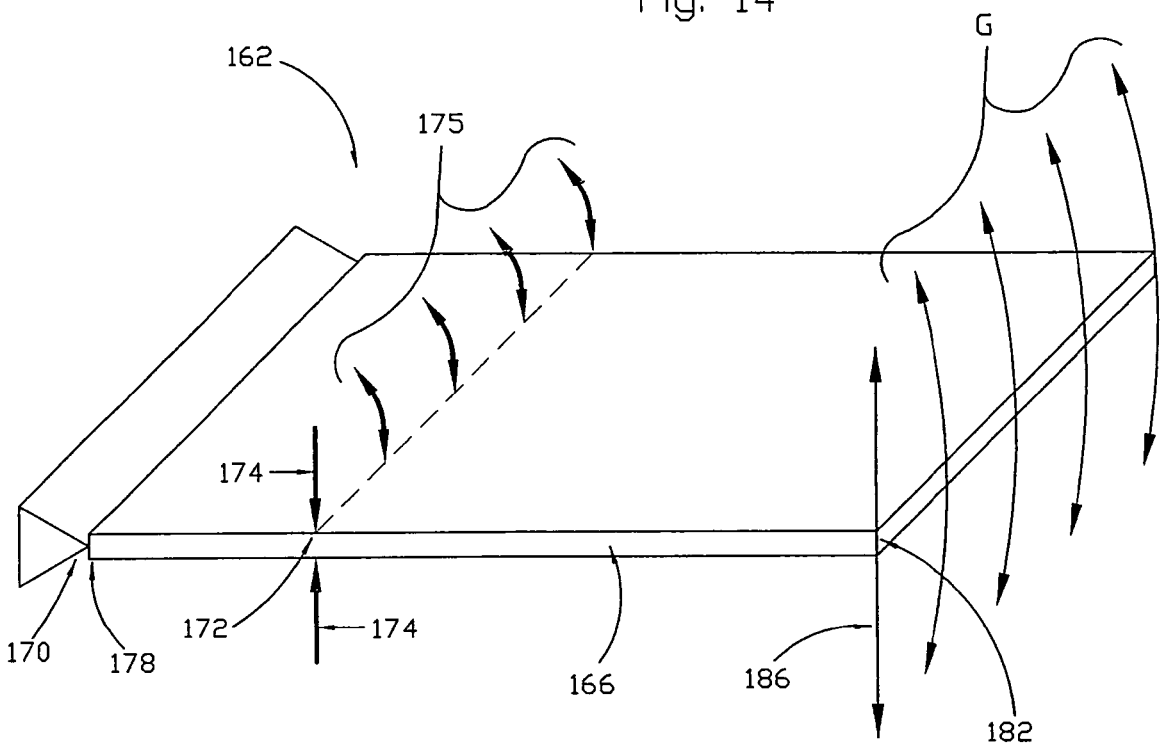
FIG. 14 illustrates an isometric view of a lever system representing the operation of the lever diaphragm in the electromagnetic audio transducer formed according to an embodiment of the present invention.

The radial movement and the mechanical method for creating the radial movement of the "lever diaphragm" of the electromagnetic audio transducer 62 (FIG. 11) enables this transducer to overcome many of the problems associated with conventional electromagnetic transducers that operate in a linear-axial motion. The mechanics and advantages of this electromagnetic lever diaphragm audio transducer 62 (FIG. 11) can best be understood by a cursory review of the mechanics of levers. FIG. 14 illustrates an isometric view of a lever system 162 representing the operation of the "lever diaphragm" of the electromagnetic audio transducer 62 (FIG. 11). The lever system 162 includes an arm or panel 166, a fulcrum 170, and an input force 174 representing the force created when the voice coil 134 (FIG. 11) is energized in the gap 130 (FIG. 11). The input force 174 is a reciprocating force that can be applied on both sides of the panel 166 and that can be applied across the entire width of the panel 166 and creates a reciprocating output force 186 at an end 182 of the panel 166. The input force 174 applied across the width of the panel 166 causes the panel 166 to rotate as shown by arrows G. A torque or moment 175 is a product of the input force 174 applied to a point 172, which extends along the width of the panel 166, and the distance between the point 172 and the moment center or fulcrum 170. Far end 182 moves the greatest distance of any point on the panel 166 while near end 178 moves the shortest distance of any point on the panel 166. The force applied by, and distance traveled by, any point on the panel 166 is a function of the mechanical advantage ratio of the distance of the input force 174 from the fulcrum 170 to the entire length of the panel 166. For example, the input force 174 is being applied away from the fulcrum 170 at the point 172 which is about ¼ the length of the panel 166. Based on this ratio of mechanical advantage, the input force 174 is four times the output force 186 realized at the end 182 of the panel 166, but the end 182 of the panel 166 travels 4 times the distance that the point 172 travels. Thus, this lever system 162 is a motion-amplifying lever beyond point 172 toward end 182.

Returning to FIG. 11, the lever action of the diaphragm in the electromagnetic audio transducer 62 enables it to maximize the movement of the panel 70, and thus the displacement of air to make sound, while minimizing the movement of the voice coil 134. For example, the magnet box 74 and voice coil 134 are positioned to operate and apply torque forces on the panel 70 at an area along the panel 70 approximately ¼ the length of the panel 70 from the pivot end 86 (the approximate point of the fulcrum). Based on the mechanical advantage ratio, the tip end 90 of the panel 70 moves four times the distance than does the area on the panel 70 where the torque forces are applied by the voice coil 134 and former 118. Therefore, unlike the axially-moving diaphragm of a conventional transducer where the voice coil must travel the same linear distance as the cone, and thus the movement of the entire cone is limited to maintain the voice coil in the gap, a large portion of the panel 70 can be moved a far greater distance than the voice coil 134 while the voice coil 134 can remain in the gap 130. In other words, the movement of the panel 70 is not limited by a 1:1 ratio to the movement of the voice coil 134 as in conventional axially-moving cone type audio transducers. Rather, the area close to the tip end 90 of the panel 70 moves a greater distance than the voice coil 134 moves by a ratio of greater than 1:1 as a function of where on the panel 70 the voice coil 134 is located. The closer the voice coil 134 and magnet box 74 are positioned to the pivot end 86 of audio transducer 62, the greater the proportion the distance the tip end 90 travels relative to the distance the voice coil 134 travels. Thus, the "lever diaphragm" of the electromagnetic audio transducer 62 can displace more air than conventional axially-moving cone type speakers while limiting the movement of the voice coil 134 to within the gap 130. Because the voice coil 134 does not have to leave the gap 130 for excessive diaphragm-air displacements, it can take on additional electrical input power and convert it to force, not just heat. In this way, the electromagnetic lever diaphragm audio transducer 62 is able to receive more electrical input power to generate higher intensity sound levels without increasing distortion or sacrificing efficiency.

The mechanical advantage ratio of the electromagnetic lever diaphragm audio transducer 62 may easily be altered to accommodate different speaker requirements. For example, because the force applied to the panel 70 from the driver is a torque and is easily changed by the positioning of the driver on the frame 66 relative to the rotational axis 98, a speaker utilizing this lever diaphragm arrangement can be easily "tuned" for a specific use. Such uses may include horn loading, sealed box direct radiator, bass-reflex, and wave-guide horns applications. Another advantage related to the positioning of the driver relative to the rotational axis 98 of the panel is the capability of altering the amount of air the panel 70 can displace. By moving the driver closer to the rotational axis 98, the tip end 90 (FIG. 11) of the panel 70 moves a greater distance relative to the distance the voice coil 134 travels in the gap 130, and thus displaces more air. Due to their structure and operation, conventional axial-reciprocating audio transducers can not easily be modified to alter the amount of force applied to the diaphragm or the distance the diaphragm travels to displace air.

Figure 15:
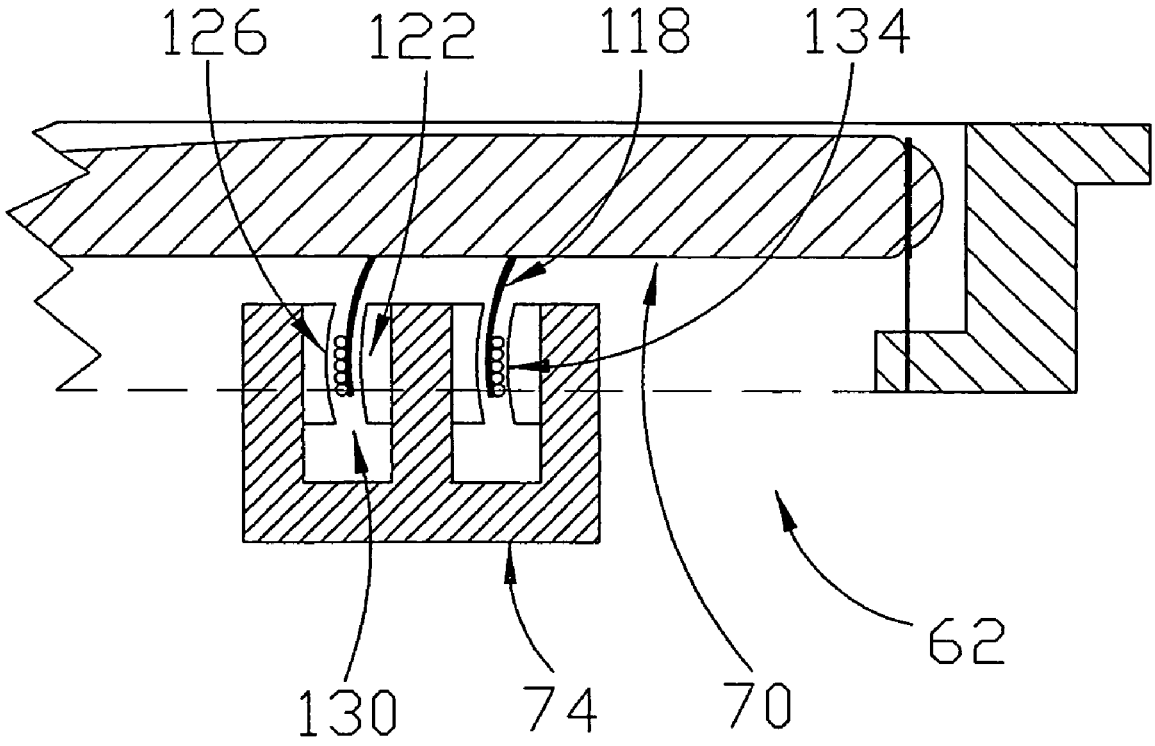
FIG. 15 illustrates a partial cross-sectional side view of an electromagnetic audio transducer formed according to an embodiment of the present invention.

Alternatively, as shown in FIG. 15, the structure of the voice coil 134 and the magnet box 74 may be altered to increase the efficiency of the electromagnetic audio transducer 62. The former 118 and voice coil 134 are curved and the inner magnet group 122 and the outer magnet group 126 are likewise curved to create a curved gap 130 to receive the curved voice coil 134. The curvature of the voice coil 134 and the gap 130 accommodates the radial movement of the panel 70 such the voice coil 134 is always situated generally at the same distance from both the inner and outer magnet groups 122 and 126 as the voice coil 134 moves along a radial path within the gap 130. Because the voice coil 134 does not move any closer to, or further from, either the inner or outer magnet groups 122 or 126 during movement, the gap 130 can be narrower than if the inner and outer magnet groups 122 and 126 had flat surfaces as shown in FIGS. 12 and 13. The narrower gap 130 improves the magnetic flux density within the gap 130 and thus improves the efficiency of the electromagnetic lever diaphragm audio transducer 62.

Figure 16:
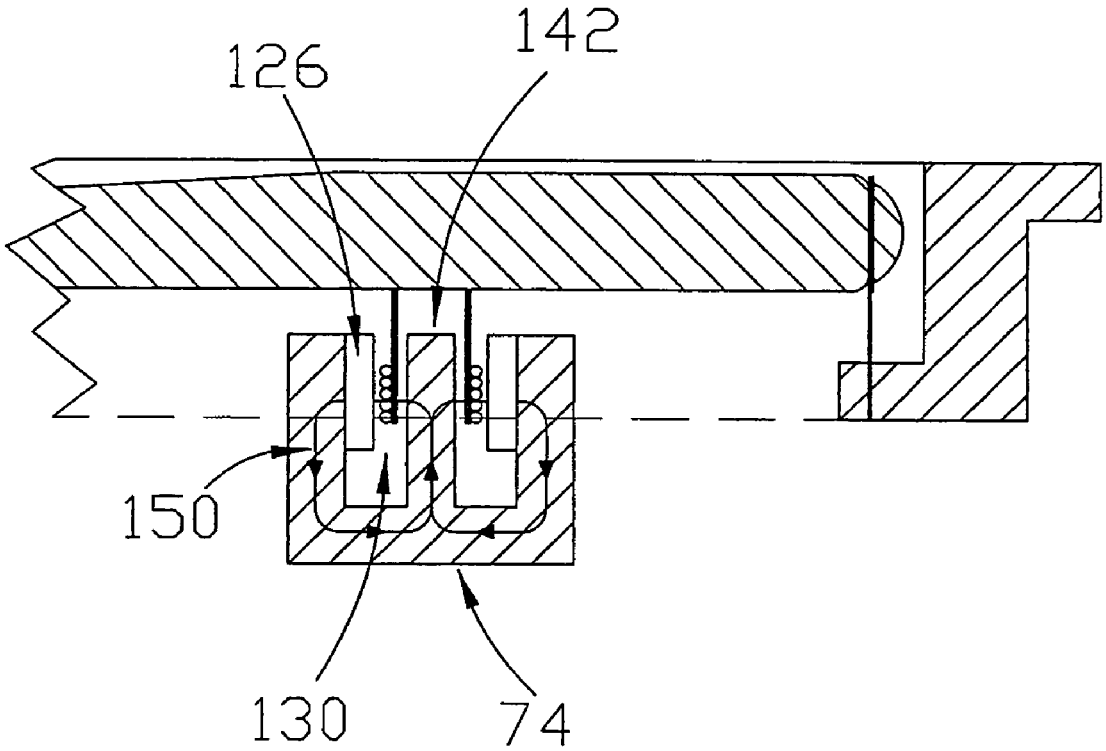
FIG. 16 illustrates a partial cross-sectional side view of an electromagnetic audio transducer formed according to an embodiment of the present invention.

Alternatively, as shown in FIG. 16, the inner magnet group 122 (FIG. 11) may be removed from the magnet box 74. As shown, the center wall 142 of the magnet box 74 does not have an inner magnet group 122 (FIG. 11) mounted thereto, rather the gap 130 is defined only by the outer magnet group 126 and the center wall 142. The center wall 142 is a ferromagnetic return path for the magnetic flux 150 provided by the outer magnet group 126. The magnetic flux 150 in the gap 130 may not be as intense in this magnetic structure, however the embodiment shown in FIG. 16 is cheaper and easier to assemble without the inner magnet group 122 (FIG. 11).

Alternatively, the magnetic structure may be reconfigured such that the permanent magnets are not directly exposed to the voice coil 134. In high power applications, the voice coil receives higher amounts of electrical energy to obtain higher sound pressure level outputs from the speaker. In such situations, the additional electrical input increases the magnetic forces of the voice coil, which are transferred to the diaphragm to create higher sound pressure levels. However, the higher electrical inputs lead to an increase in voice coil temperature. The permanent magnets used in the electromagnetic lever diaphragm transducer 62 may be of the Neodymium type. These magnets are susceptible to damage (demagnetization) by heating them beyond their Curie temperature, at which point the magnets will permanently start to demagnetize. One way to reduce the heat received by the permanent magnets is to move the magnets away from the gap and conduct the magnetic field created by the magnets to the gap through a highly permeable conductor, such as iron, that defines the gap. This way the heat generated by the voice coil within the gap will be received and absorbed by the highly permeable conductor and can be dissipated below the Curie temperature before reaching the permanent magnets. A magnetic structure with a gap defined by a highly permeable material having a magnetic field provided in the gap by conducting the magnetic field from the permanent magnets to the gap through the highly permeable material and thus not directly exposing to the magnets to the voice coil can be easily adapted and employed in the embodiments disclosed herein.

Figure 17:
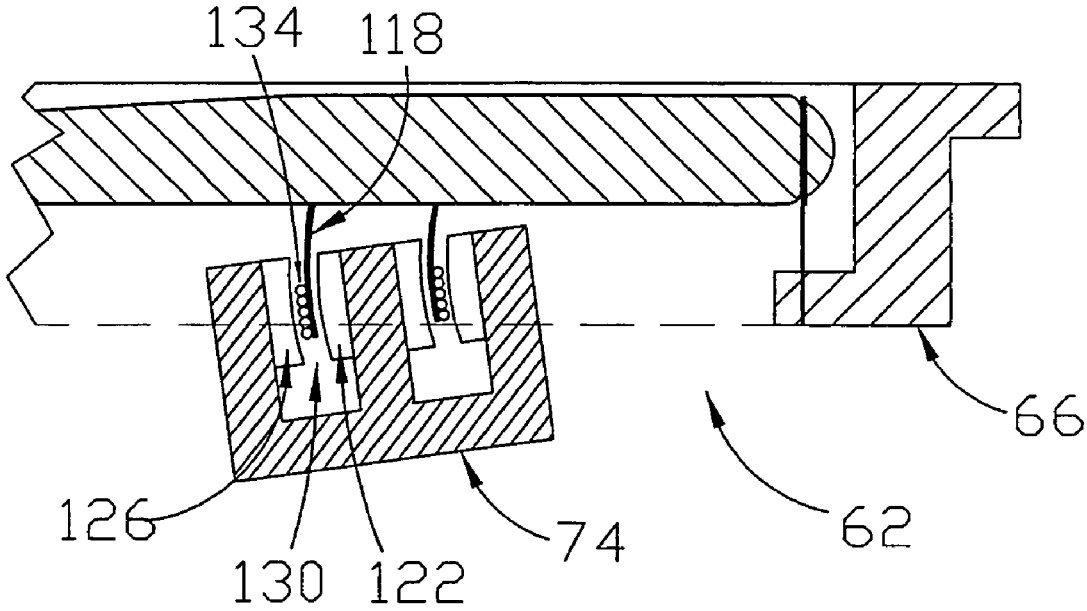
FIG. 17 illustrates a partial cross-sectional side view of an electromagnetic audio transducer formed according to an embodiment of the present invention.

Alternatively, as shown in FIG. 17, the orientation of the magnet box 74 may be altered to allow a better reception of the voice coil 134 of transducer 62. The former 118, voice coil 134, inner and outer magnet groups 122 and 126, and gap 130 are all curved. The magnet box 74 is positioned on the frame 66 at a non-perpendicular angle to the frame 66 such that the magnet box 74 is oriented to better receive the voice coil 134 moving in a radial path. By orienting the magnet box 74 as such relative to the axis of rotation, the mechanical efficiency of the transducer 62 may be improved in the embodiment of FIG. 17.

Figure 18:
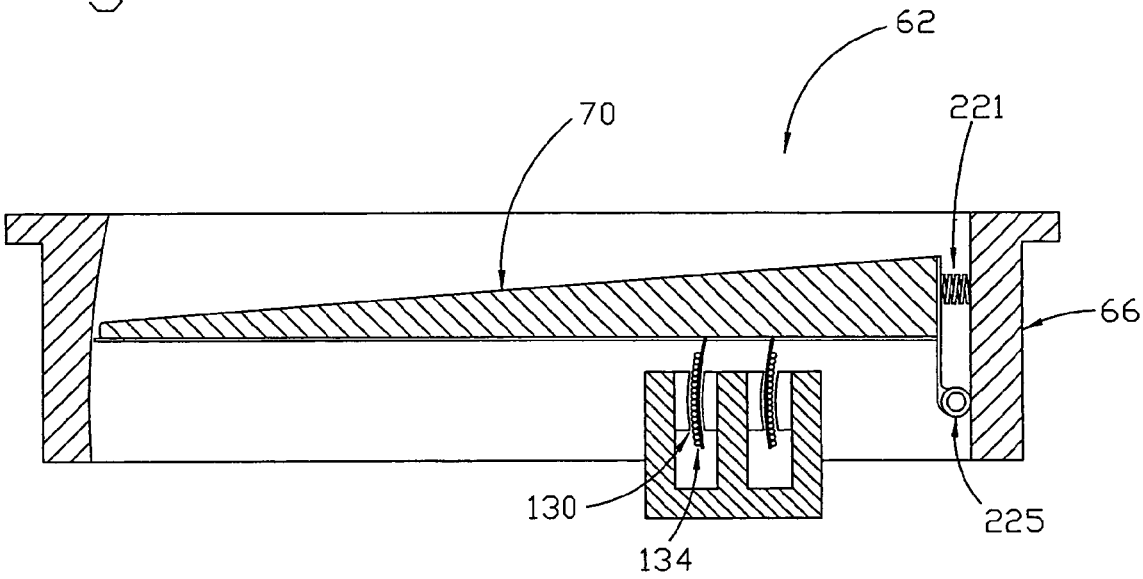
FIG. 18 illustrates a cross-sectional side view of an electromagnetic audio transducer formed according to an embodiment of the present invention.

Alternatively, as shown in FIG. 18, an "overhung" voice coil 134 can be used with the electromagnetic audio transducer 62. The voice coil 134 extends out of the gap 130 when the voice coil 134 is in the rest position. By extending the length of the voice coil 134, the panel 70 is able to rotate even greater distances while a portion of the voice coil 134 stays within the gap 130. Because the voice coil 134 is larger and extends out of the gap 130, the voice coil 134 dissipates more electrical power as heat and thus may be less efficient. However, the loss in efficiency is offset by an increase in the low frequency performance of the transducer 62 due to the increase in the volume of air the panel 70 displaces by being able to travel a greater distance. Also, the panel 70 may be rotatably connected or coupled to the frame 66 by a bearing, bushing, or hinge 225 and a spring 221 instead of by a flexible strip. The spring 221 resists the rotation of the panel 70 and applies pressure to the panel 70 to maintain the panel 70 and voice coil 134 in a center position when at a rest position as shown in FIG. 18.

Figure 19:
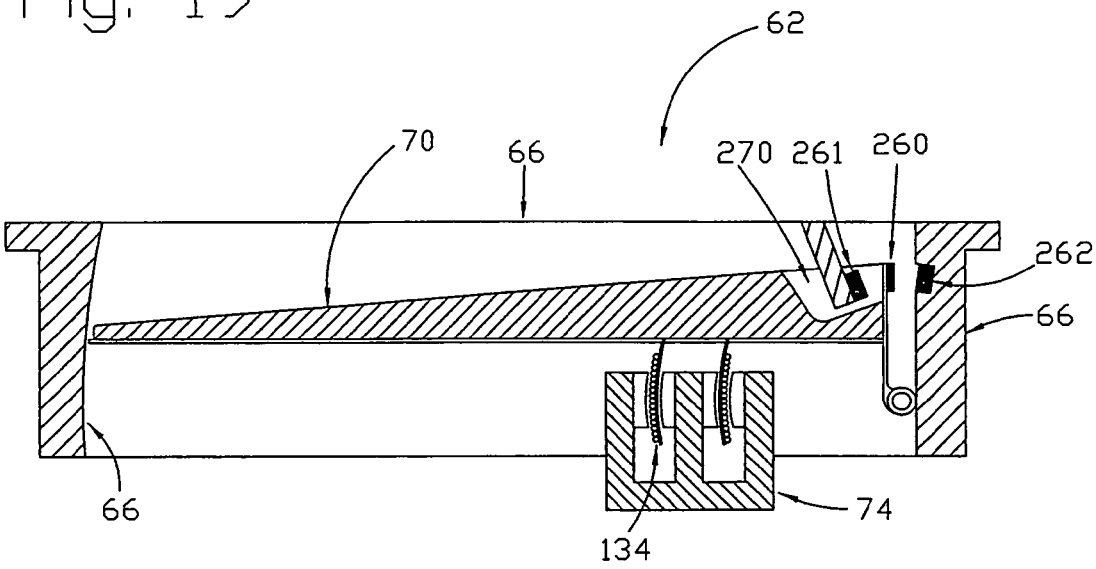
FIG. 19 illustrates a cross-sectional side view of an electromagnetic audio transducer formed according to an embodiment of the present invention.

Alternatively, the transducer 62 shown in FIG. 19, has the spring 221 (FIG. 18) removed and replaced by another type of suspension system. Here a magnet 260 or a plurality of magnets 260 are attached to the panel 70. Another corresponding group of magnets 261 and 262 are fixed to the frame 66. Panel 70 may have grooves 270 to provide clearance for the magnet group 261. The orientation of the poles of the magnets are such that magnet 260 is repulsed by both magnets in the group 261 and 262. Magnet 260 will be repulsed such that it will be maintained at an equal distance between magnet group 261 and 262. In operation, when the panel 70 is rotated about its axis in either direction, the magnet 260 will move closer to either magnet group 261 or 262. As the magnet 260 moves closer to either magnet group 261 or 262, the repulsion force between the magnets will increase like the compressing of a spring. This repulsing force will resist the movement of the panel 70, and when the panel 70 is not rotating the magnet 260 will be pushed into a centering, equidistant position between the magnet groups 261 and 262 to return the panel 70 and voice coil 134 to a centered rest position. The advantage with a magnetic suspension system is that there are no parts to wear out. Also, in different operating temperatures, the magnetic repulsion forces are more stable than spring materials that tend to get stiffer as temperatures decrease. For example, in conventional speaker systems, the suspension system of surrounds and spiders tends to become stiff in low temperatures and change the operating characteristics of the speaker. Also, the surround and spiders tend to become loose and wear out over time. Alternately, the magnet group 260 may be located at different positions on the panel 70 and the magnet group 261 and 262 may be correspondingly located at different positions on the frame 66 or magnet box 74. The advantage in having the magnet group 260 located in the position as shown in FIG. 19 is that the moment of inertia of the magnet 260 is kept to a minimum.

In an alternative embodiment, the panel 70 of FIG. 11 may be coupled to the opposite first and second members 101 and 103 (FIG. 6) of the side wall 82 of the frame 66 by a coupling of at least a pin or axle and bearing that is located between the tip end 90 and the pivot end 86. The panel 70 may rotate within the frame 66 along a rotational axis about the coupling. In such an orientation, the pivot end 86 and tip end 90 of the panel 70 are both free to move radially, in a "see-saw" fashion within the frame 66. Also, a voice coil 134 may be coupled to the panel 70 on either or both sides of the pin and bearing and a magnet box 74, may be directly or indirectly connected to the frame 66 on either or both sides of the pin and bearing to receive the voice coil 134 to move the panel 70.

Figure 26:
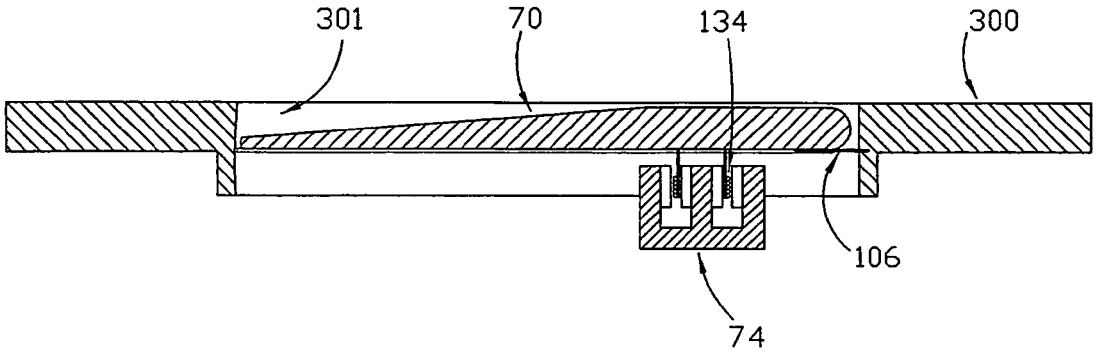
FIG. 26 illustrates a cross sectional side view of a panel mounted within a baffle formed according to an embodiment of the present invention.
Figure 27:
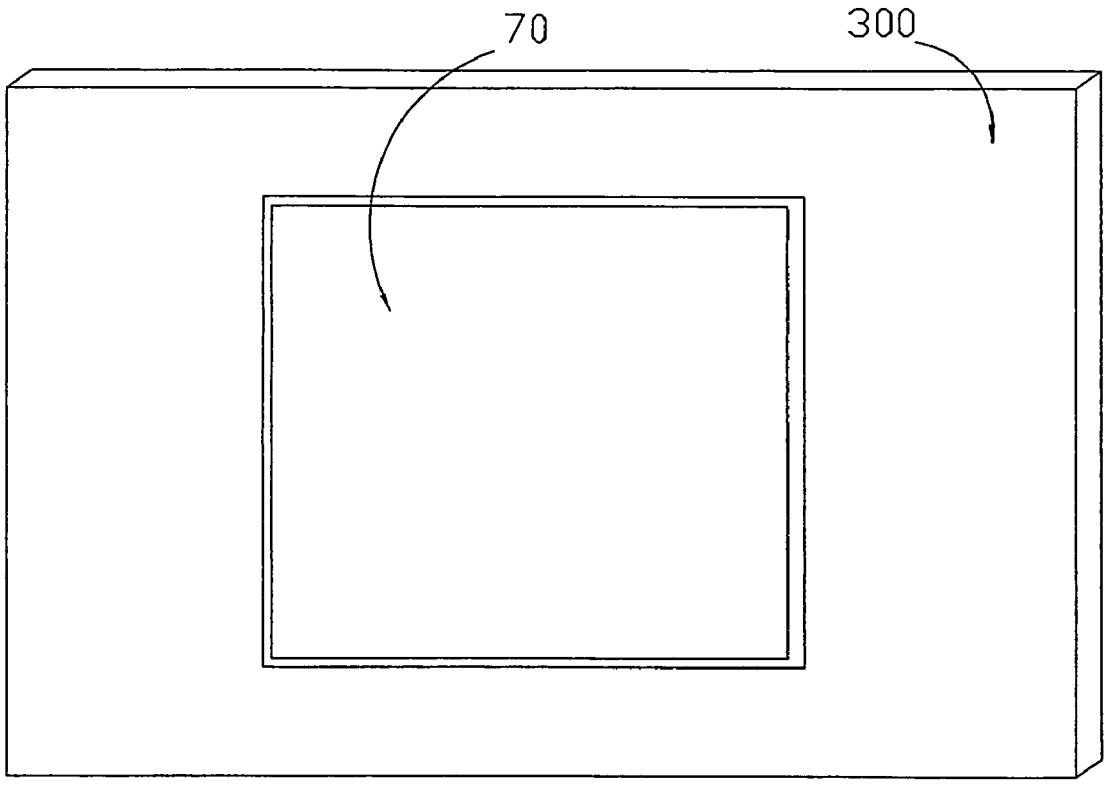
FIG. 27 illustrates an isometric front view of the panel and baffle of FIG. 26.
Figure 28:
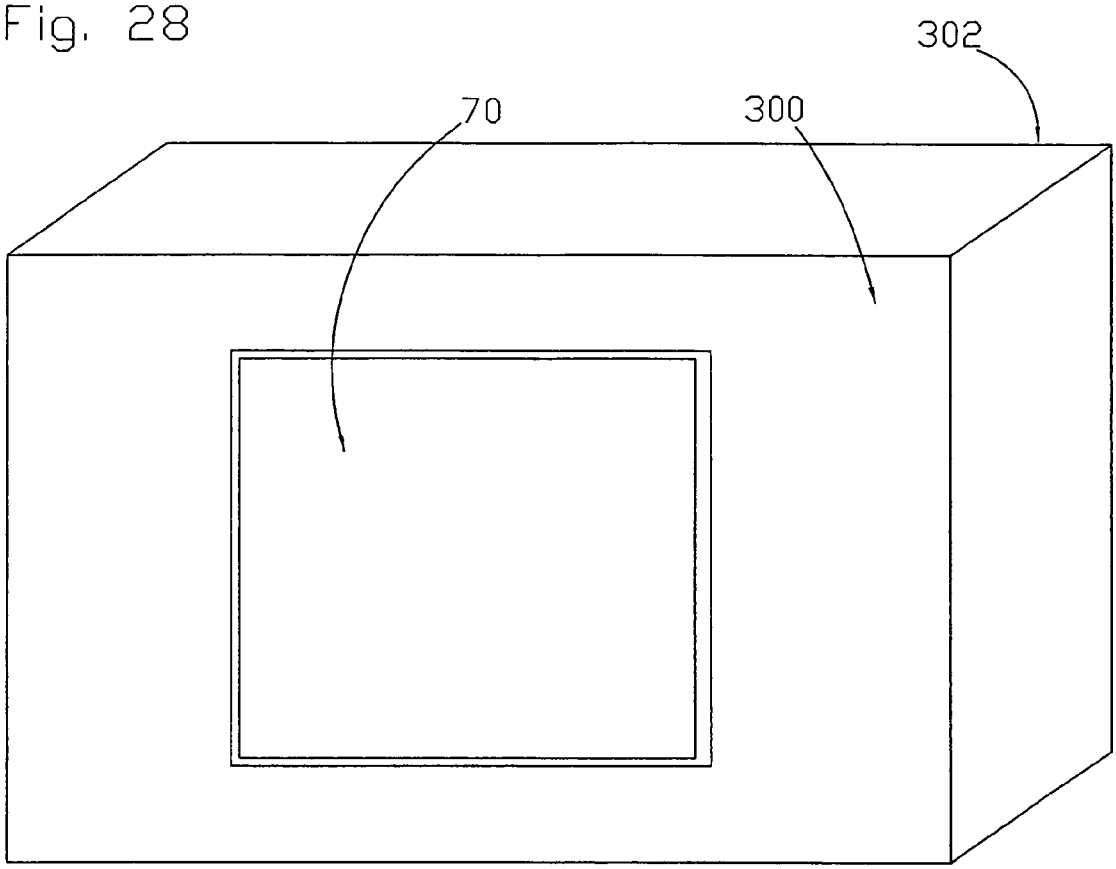
FIG. 28 illustrates an isometric front view of a panel mounted within a baffle of a speaker box formed according to an embodiment of the present invention.

Alternatively, as shown in FIGS. 26 and 27, the panel 70 may be disposed within an aperture 301 of a baffle 300. The baffle 300 is a partition that prevents interference between sound waves. A magnet box 74 may be mounted to the baffle 300 to engage the coil 134 coupled to the panel 70, and thus serve as an actuator, to rotate the panel 70 relative to the baffle 300. The panel 70 is suspended within the aperture 301 by coupling the panel 70 to the baffle 300 with a thin flexible material 106. The coupling provides an axis for rotation of the panel 70. Alternatively, any of the other methods described herein for coupling the panel 70 to a frame to rotate the panel 70 such as a bearing or axle, or centering via a spring or magnetics may be employed to suspend the panel 70 within the baffle 300. The panel 70 rotates and operates within the enclosed baffle 300 in the same way it operates within the frame 66 of FIG. 5. Alternatively, more than one panel 70 and actuator mechanism 74 may be mounted into a single baffle 300. Alternatively, the panel 70 may be disposed within an aperture of a baffle 300 of an enclosed hollow box 302 as shown in FIG. 28. The hollow box 302 may be an enclosure or a speaker box and may be any number of shapes.

Figure 20:
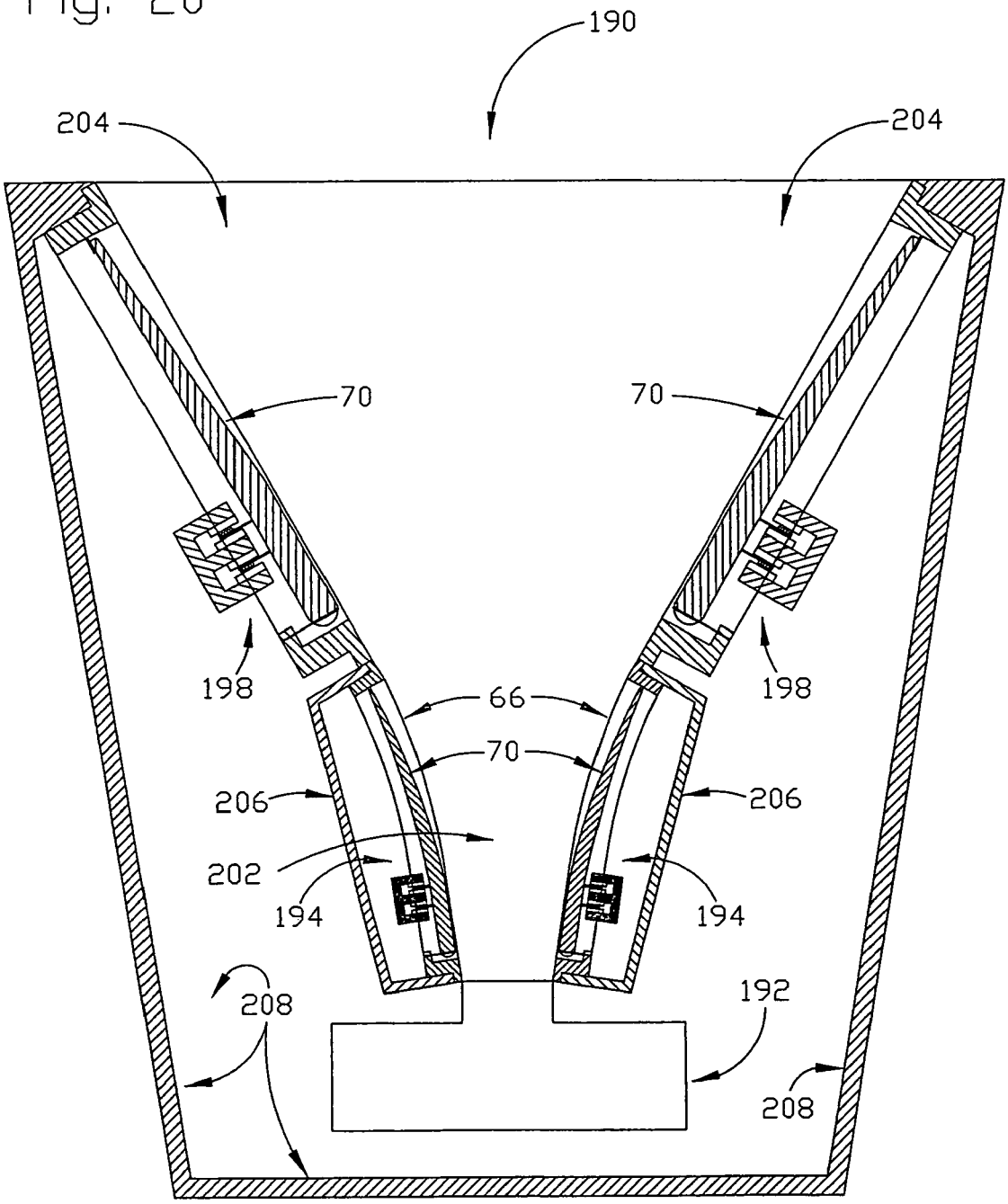
FIG. 20 illustrates a cross-sectional top view of a speaker system formed according to an embodiment of the present invention.
Figure 21:
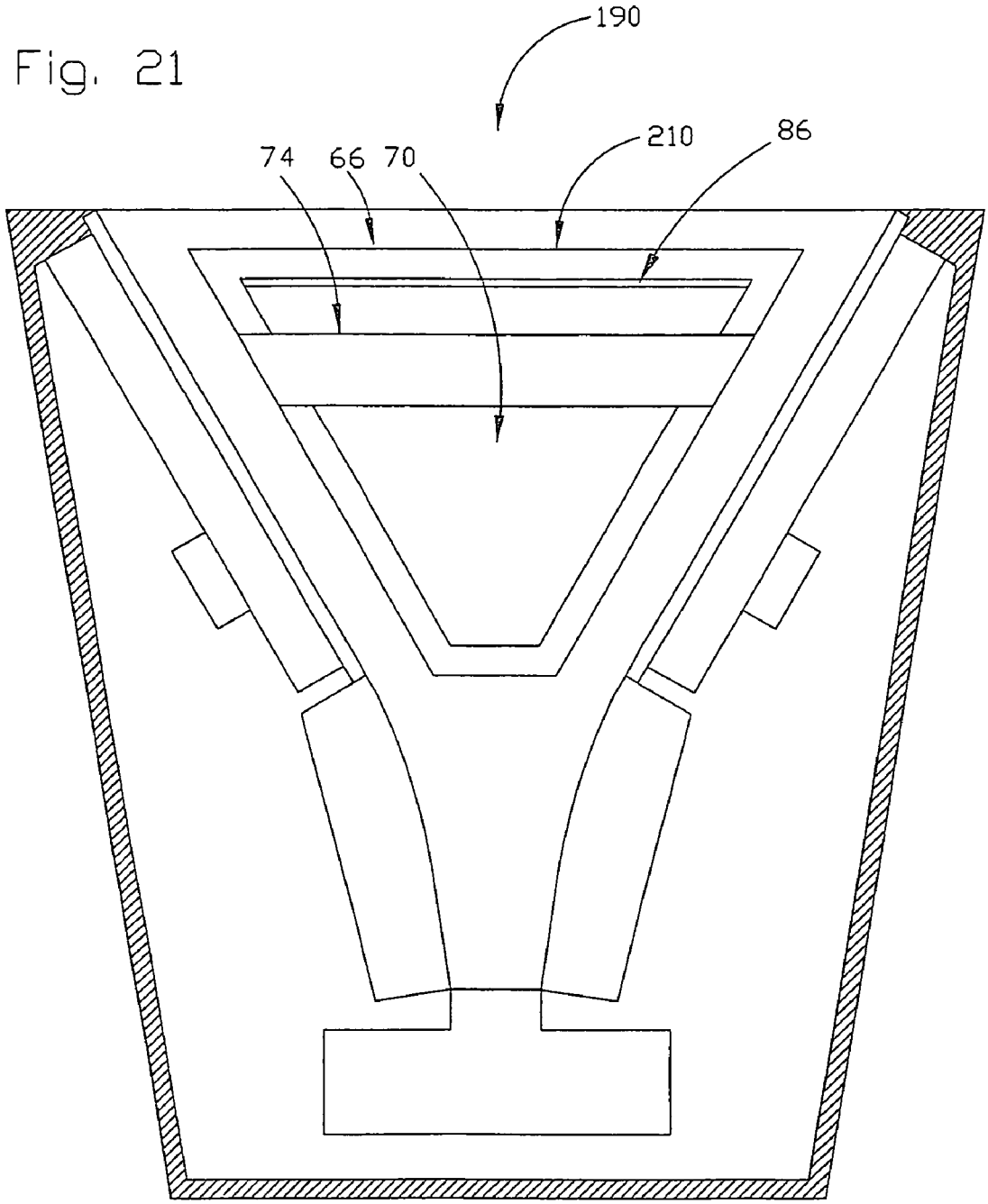
FIG. 21 illustrates a cross-sectional top view of a speaker system formed according to an embodiment of the present invention.

Often, multiple audio transducers are combined together on a single horn where each transducer emits a different frequency range of sound waves into the horn and the sound waves are acoustically combined together before exiting the horn into free air space. Such transducer-horn arrangements serve to match the impedance of the acoustic load of the air to each audio transducer and to direct and set the path of the sound waves produced within the horn by the multiple audio transducers. As shown in FIGS. 20 and 21, multiple audio transducers that produce sound in different frequency ranges are combined together to define a horn and create a horn-speaker system assembly 190 with a full range of sound. FIG. 20 illustrates a top cross-sectional view of a speaker system assembly 190 using at least one conventional high-frequency device 192 (shown not as a cross-sectional view, but as a whole view), and mid-frequency and low-frequency electromagnetic lever diaphragm audio transducers 194 and 198 mounted in the enclosure 208 such that a horn is created with a throat section 202 and a mouth section 204. The panels 70 of the low-frequency transducers 198 are planar and tapered. The enclosure 208 captures and contains the sound pressures from the back side of panels 70 of the transducers 198. Likewise the enclosure 206 capture and contain the sound pressures from the back sides of panels 70 of the transducers 194 and also provide a barrier from the low frequency sound pressures of transducers 198. The high frequency device 192, or driver, generates high frequency audio sound pressure waves.

The panels 70 and frames 66 of the mid-frequency transducers 194 may be curved to better accommodate the flare rate of the horn at the throat section 202 for the high-frequency driver 192. The curvature of the panels 70 and frames 66 of the mid-frequency transducers 194 also provides a minimally obstructive wave-guide path for the high frequency sound waves emanating from the high frequency driver 192. For example, high frequency sound waves emitted from the driver 192 pass along, and are directed by, the smooth curved panels 70 of the mid-frequency transducers 194 with minimal interference. Even with the panels 70 of the mid-frequency transducers 194 reciprocating from peak to peak during operation, the shape and position of the panels 70 interfere very little with the main path of the high frequency sound waves emanating from the driver 192. Similarly, the tapered panels 70 of the low-frequency transducers 198 interfere very little with the sound waves emitted from the high frequency driver 192 and the mid-frequency transducers 194. Alternatively, the speaker system 190 is not limited to use with a conventional high frequency driver 192. For example, another electromagnetic lever diaphragm audio transducer may be adapted to be used as a high frequency driver in the speaker system 190.

Walls make up the solid boundaries of a horn system and create a path for directing sound waves produced by transducers in conjunction with the horn out of the horn into free air space. The walls also set up an impedance matching function for the transducers. The panels 70 of the electromagnetic lever diaphragm audio transducers 194 and 198 can easily be adapted into a horn where the panels 70 are solid boundaries for directing sound waves produced by other transducers in the horn system. Additionally, the panels 70 radiate their own range of sound frequencies into the horn. The panels 70 of the electromagnetic lever diaphragm audio transducers 194 and 198 of the speaker system 190 become integral active walls of the horn. By using the electromagnetic lever diaphragm audio transducers 194 and 198 as integral active walls of the horn, the speaker system 190 can be smaller and lighter than conventional speaker systems. Alternatively, the orientation of the transducers 194 or 198 in the speaker system 190 may be arranged such that the pivot end and the driver associated with each transducer are positioned nearer the mouth 204 of the horn. The tip ends of the panels 70, which have the greatest radial movement, are nearer the throat 202 of the horn. This arrangement of the transducers may improve the impedance matching of the speaker system 190.

Alternatively, as shown in FIG. 21, the speaker system 190 may include an additional electromagnetic lever diaphragm audio transducer 210 with a trapezoidal shaped panel 70 and frame 66 mounted in the top of the horn of the speaker system 190. Alternatively, another electromagnetic lever diaphragm audio transducer with a trapezoidal shaped panel 70 and frame 66 may be mounted in the bottom of the horn of speaker system 190. The additional electromagnetic lever diaphragm audio transducer 210 increases the sound intensity level of the range of frequencies they are producing in the horn before being radiated out of the speaker system 190. As shown, the magnet box 74 and pivot end 86 is positioned at the wider end of the trapezoidal frame 66 to receive the voice coil 134 (not shown) on the trapezoidal panel 70. Alternatively, the magnet box 74 and pivot end 86 may be positioned at the narrow end of the trapezoidal frame 66 to receive the voice coil 134 (not shown) on the trapezoidal panel 70.

Alternatively, the electromagnetic lever diaphragm audio transducer 210 may have any number of other shapes to accommodate the shape of a speaker system. By way of example only, the electromagnetic lever diaphragm audio transducer 210, and its panel 70 and frame 66, may be shaped like a square, rectangle, triangle, semi-circle, or any other shape suitable for use with a speaker system. Furthermore, the voice coil 134 and magnet box 74 may be positioned at different locations and orientations on the panel 70 and frame 66, respectively, to rotate the panel 70 about the rotational axis.

Alternatively, a generally trapezoidal shaped transducer panel or diaphragm may be used in other embodiments.

Figure 22:
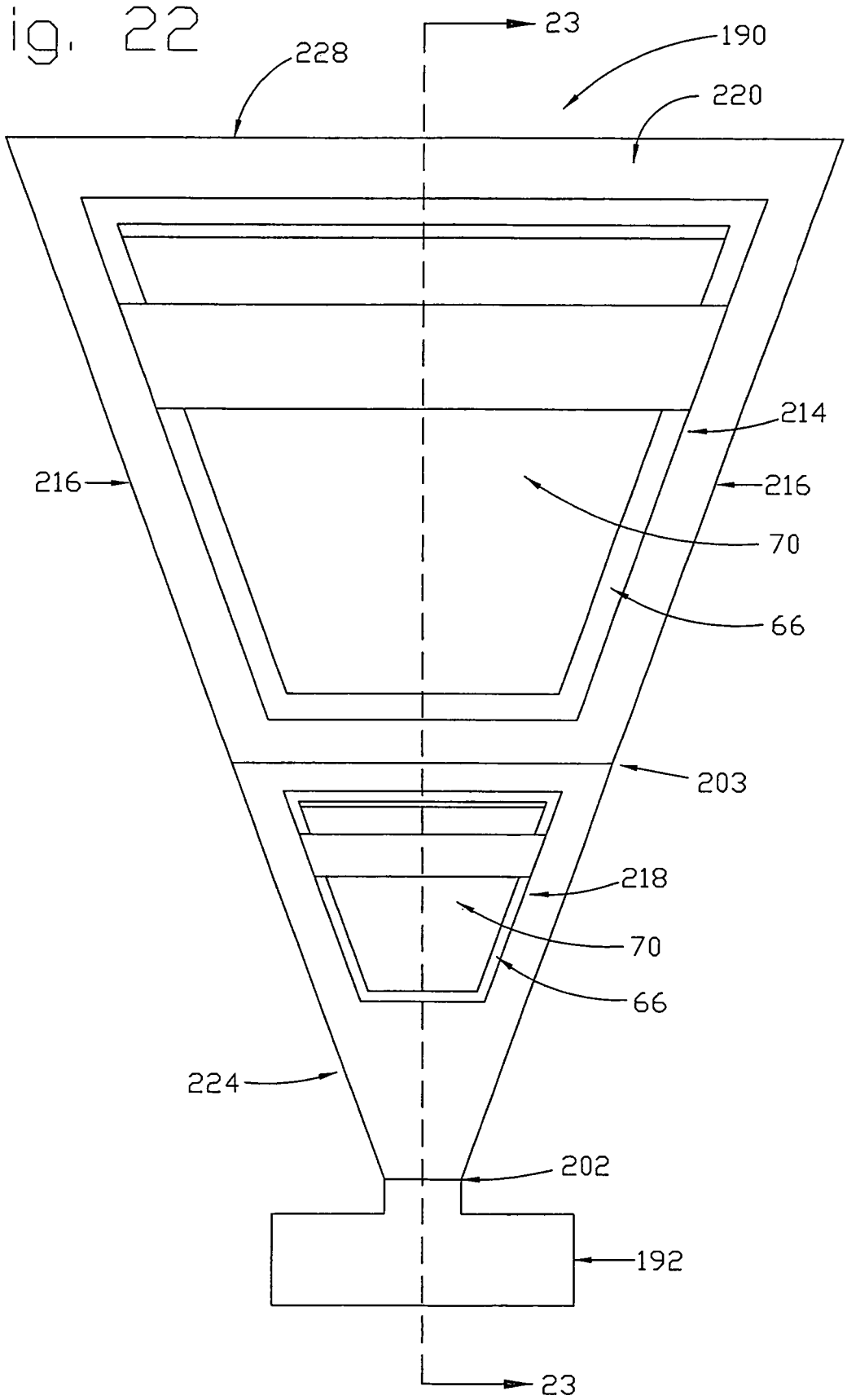
FIG. 22 illustrates a side view of a speaker horn formed according to an embodiment of the present invention.
Figure 23:
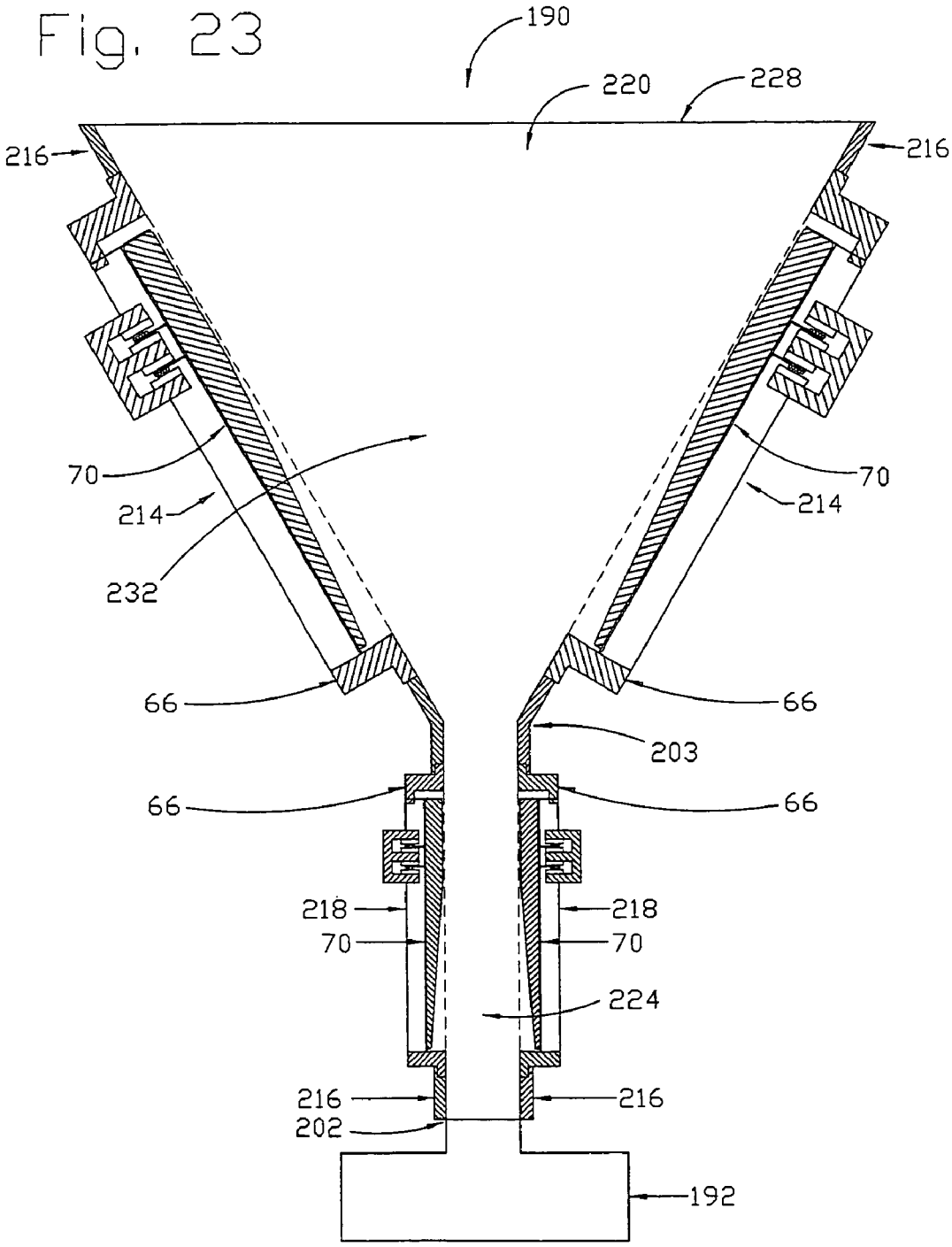
FIG. 23 illustrates a top cross-sectional view of the speaker horn of FIG. 22 taken along lines 23-23.

FIGS. 22 through 25 show horn-speaker systems without the pneumatically sealing enclosures of 206 and 208 as shown in FIG. 20. In operation, the enclosures 206 and 208 can be adapted for use with the working systems as depicted in FIGS. 22 through 25. FIGS. 22 and 23 show a speaker system 190 having a series of trapezoidal walls 216 connected together at the edges to form the boundaries of a horn 220. The horn 220 has a vertical flaring section 224 beginning at the throat 202 of the driver 192 that extends to a mouth 228 of the horn 220. Referring to the top view of FIG. 23, a horizontal flare begins at point 203 and is maintained to the mouth 228 of the horn 220. This final flaring section 232 (or bell of the horn) dictates a constant directivity angle of the horn 220 for exiting sound waves produced within the horn 220 by the audio transducers.

Referring to FIG. 22, a low-frequency electromagnetic lever diaphragm audio transducer 214 and a mid-frequency electromagnetic lever diaphragm audio transducer 218, each having a trapezoidal shaped panel 70, may be mounted in a wall 216 of the horn 220. Referring to FIG. 23, the transducers 214 and 218 with the trapezoidal panels 70 may be mounted in opposite walls 216 of the horn 220. The low-frequency transducers 214 are mounted opposite each other along the bell 232 of the horn 220 between point 203 of the horn 220 and the mouth 228. Similarly, the mid-frequency transducers 218 are mounted opposite each other between the throat 202 and the point 203 on the horn 220. The trapezoidal shaped panel 70 and frame 66 of each transducer 214 and 218 allow the transducers 214 and 218 to be used within the flared shape of the horn 220. Alternatively, the horn 220 may include any number of electromagnetic lever diaphragm audio transducers with a trapezoidal panel 70 in each wall 216 in the horn 220.

Figure 24:
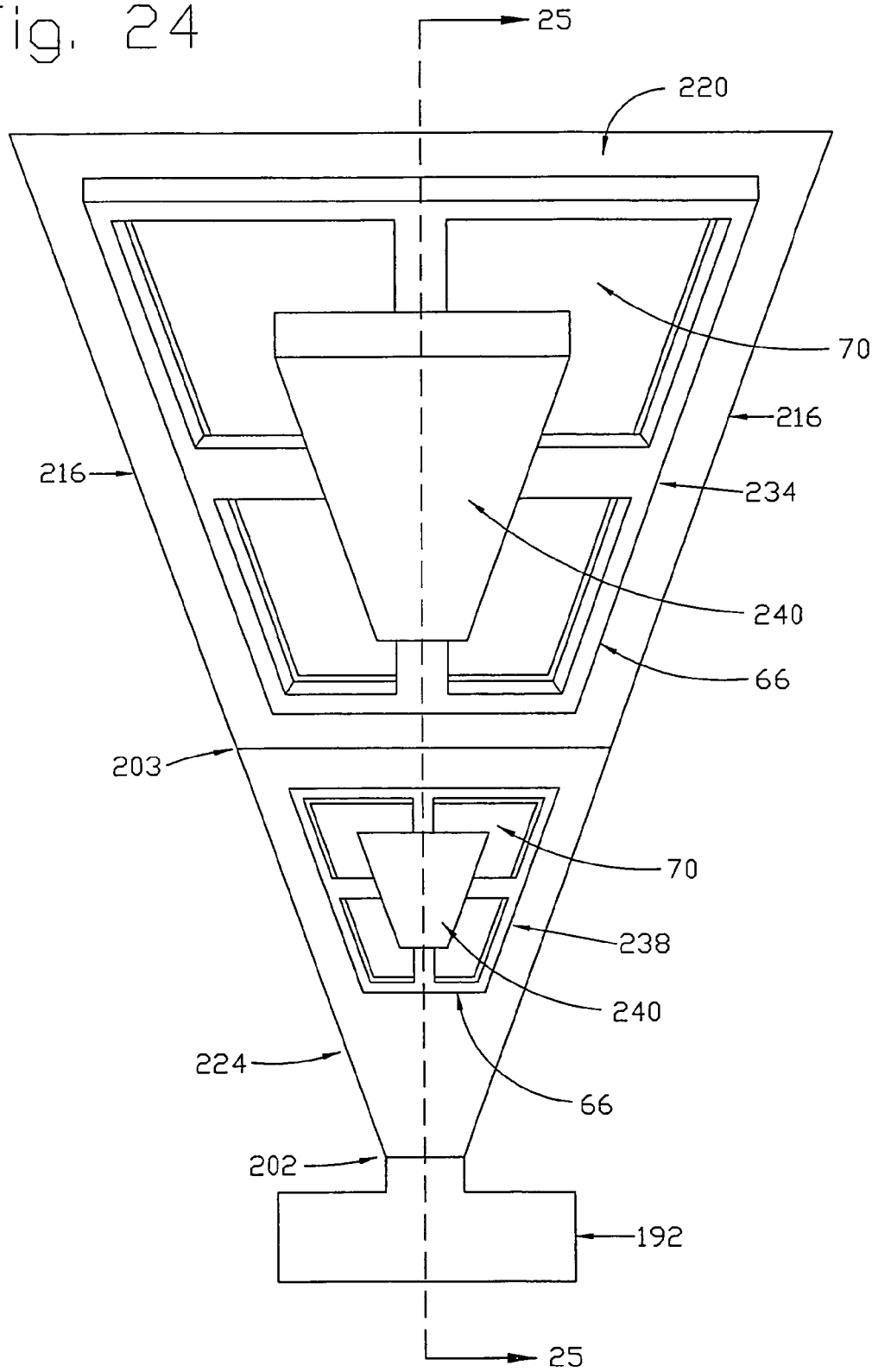
FIG. 24 illustrates a side view of a speaker horn formed according to an embodiment of the present invention.
Figure 25:
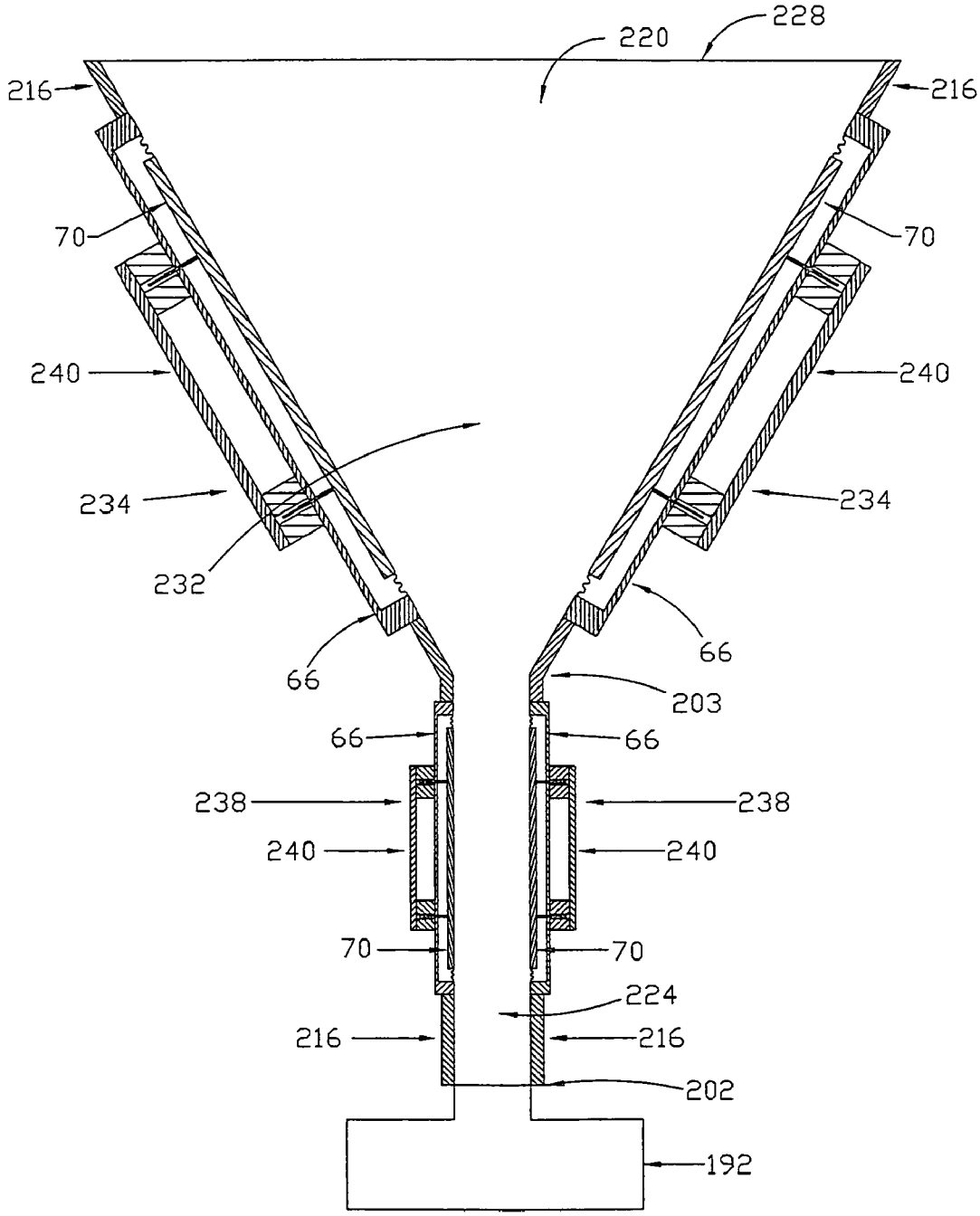
FIG. 25 illustrates a top cross-sectional view of the speaker horn of FIG. 24 taken along lines 25-25.

Alternatively, the trapezoidal panel 70 may be used with a conventional axial-reciprocating transducer in a horn arrangement. FIGS. 24 and 25 illustrate a horn 220 similar to that shown in FIGS. 22 and 23 except that the transducers are axial-reciprocating flat panel low and mid-frequency audio transducers 234 and 238 instead of electromagnetic lever diaphragm audio transducers. Referring to FIG. 24, the low-frequency transducer 234 and the mid-frequency transducer 238, each having a trapezoidal shaped panel 70 connected to an axial-driving driver system 240, may be mounted in a wall 216 of the horn 220. Referring to FIG. 25, the transducers 234 and 238 with the trapezoidal panels 70 may be mounted in opposite walls 216 of the horn 220. The low-frequency transducers 234 are mounted opposite each other along the bell 232 of the horn 220 between the point 203 of the horn 220 and the mouth 228. Similarly, the mid-frequency transducers 238 are mounted opposite each other along the vertical flare 224 between the throat 202 and the point 203 on the horn 220. The trapezoidal shaped panel 70 and frame 66 of the transducers 234 and 238 allow the transducers 234 and 238 to be used within the flared shape of the horn 220. Alternatively, the horn 220 may include any number of conventional axial-reciprocating flat panel audio transducers with a trapezoidal panel 70 in each wall 216 in the horn 220.

The trapezoidal shape of the panels 70 and frames 66 of FIGS. 22-25 allow the transducers 214, 218, 234, and 238 to be used in speaker-horn arrangements whereby they provide several benefits over conventional round shaped transducers. The trapezoidal panels 70 use most of the space along the horn walls 216 and provide continuity to the angled horn walls 216 so as not to disrupt the sound wave path of each other transducer within the horn 220. The trapezoidal panels 70 also are not just static horn wall boundaries, but serve as integral active horn wall boundaries. In other words, besides serving as a wave guide for each other transducer, each panel 70 also produces its own sound waves across a range of frequencies.

Alternatively, any of the above-described embodiments may be combined and interchanged in any number of ways to result in an embodiment that suits the needs for a particular speaker system.

The different embodiments of the electromagnetic lever diaphragm audio transducer provide numerous benefits and improvements over conventional axial-reciprocating audio transducers. First, as discussed earlier, the movement of the lever diaphragm or panel is not tied to the movement of the voice coil by a 1:1 ratio. Rather, because of the lever design of the diaphragm in the transducer, the tip end of the panel moves a greater distance than the voice coil. Thus, the diaphragm panel can displace more air than a conventional axial-reciprocating cone style speaker while maintaining the voice coil in the gap. Therefore, the electromagnetic lever diaphragm audio transducer can receive higher electrical input signals at lower frequencies to produce a higher level sound intensity without creating distortion or sacrificing efficiency. The problems associated with axial-reciprocating cone style audio transducers as described in the prior art are reduced by the electromagnetic lever diaphragm audio transducer.

Second, the lever diaphragm and associated parts in the electromagnetic lever diaphragm audio transducer experience less adverse inertial effects during movement than do the similar moving parts in conventional audio transducers. The total masses associated with the moving parts of conventional axially-reciprocating audio transducers are in a fixed relationship to the inertial forces opposing their movement. The inertial forces encountered by the moving parts in the electromagnetic lever diaphragm audio transducer of the present invention are a function of their masses in relation to their distance from the pivot end, or fulcrum, of the lever diaphragm panel. For example, the high-mass voice coil is positioned close to the pivot end to reduce the moment of inertia of the voice coil. Conversely, while the tip end of the panel is furthest away from the fulcrum and thus has the largest moment, the tip end also has low mass such that it will create only a limited amount of inertia on the moving panel. By being able to reduce inertial forces by maintaining the high mass components of the electromagnetic lever diaphragm audio transducer close to the fulcrum, the electromagnetic lever diaphragm audio transducer is more efficient than conventional transducers. Also, by this method of limiting the moment of the voice coil to reduce the effects of inertia, larger, more powerful voice coils can be used in the electromagnetic lever diaphragm audio transducer to receive larger electrical inputs to create higher sound level outputs without a significant increase in inertia.

The lever design of the electromagnetic lever diaphragm audio transducer also allows for a stronger, more robust suspension system without increasing inertial effects on the movement of the diaphragm or panel. The fulcrum of the electromagnetic lever diaphragm audio transducer is located at the axis of rotation and therefore can be made of heavy, strong materials without significantly increasing inertia on the moving panel. Therefore, the suspension system of the electromagnetic lever diaphragm audio transducer can be made much stronger than the suspension systems of conventional axially-reciprocating audio transducers without creating additional inertia on the diaphragm of the transducer.

The lever design of the electromagnetic lever diaphragm audio transducer further improves on conventional transducers by eliminating the need for a surround and spider to center and suspend the panel and voice coil. The masses of the surround and spider add to the inertia on the axially-reciprocating diaphragm in conventional audio transducers. The surround and spider further limit the range of motion of the axially-reciprocating cone and add mechanical resistance to that motion. In the electromagnetic lever diaphragm audio transducer, the robust suspension system at the fulcrum suspends and centers the panel and voice coil and allows the panel a greater range of movement while limiting inertial effects and thus increasing the efficiency of the electromagnetic lever diaphragm audio transducer.

Furthermore, the diaphragm design of the electromagnetic lever diaphragm audio transducer improves on conventional audio transducers by its ability to be easily adapted into a multiple-transducer horn-speaker system. The ability to shape the diaphragm or panel in accordance with the geometrical needs of the specific horn design allows the panel to be used as an integral active waveguide wall of the horn. The panel of one electromagnetic lever diaphragm audio transducer emits a range of sound frequencies into the horn while at the same time guiding the sound waves of the other transducers within the horn system with a minimal disruption in the continuity of the horn geometry.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A transducer, comprising:

a frame;

a panel disposed within said frame and coupled to said frame such that said panel may rotate relative to said frame about a rotational axis; and an actuator positioned to engage said panel such that said panel rotates about said rotational axis to displace air, said actuator including a conductive coil mounted to said panel that moves in a radial path as the panel rotates.

2. The transducer of claim 1, wherein said actuator includes a magnetic structure having a gap in which a magnetic field is provided, said conductive coil being disposed within said gap such that said conductive coil moves relative to said magnetic structure within said gap.

3. The transducer of claim 1, wherein said actuator includes a former connected to said panel, said former having said conductive coil connected thereto.

4. The transducer of claim 1, wherein said panel has a first end coupled to said frame such that said panel rotates about said rotational axis at the coupling between said first end and said frame.

5. The transducer of claim 1, wherein said panel includes a first end that is coupled to said frame by a flexible sheet, said flexible sheet being connected to said first end of said panel and to said frame such that said flexible sheet flexes as said panel rotates.

6. The transducer of claim 1, wherein said panel is coupled to said frame by a bearing such that said panel rotates about said bearing relative to said frame.

7. The transducer of claim 1, wherein said panel is in a first position when said panel is not rotating about said rotational axis, said panel being connected to a spring such that as said panel rotates, said spring resists said rotation of said panel and such that when said panel is not rotating, said spring maintains said panel in said first position.

8. The transducer of claim 1, wherein said panel is in a first position when said panel is not rotating about said rotational axis, said panel including a first magnet and said frame including a second magnet and a third magnet, said first magnet being oriented relative to said second magnet and said third magnet such that as said panel rotates, said first magnet is magnetically repulsed by said second magnet and said third magnet and such that when said panel is not rotating, said magnetic repulsion maintains said panel in said first position.

9. The transducer of claim 1, wherein said panel includes a seal extending toward said frame.

10. The transducer of claim 1, wherein said transducer is combined with at least one other transducer to form a system of transducers.

11. The transducer of claim 1, wherein said panel has a planar shape.

12. The transducer of claim 1, wherein said panel is curved.

13. The transducer of claim 1, wherein said panel is tapered.

14. The transducer of claim 1, wherein said actuator has a plurality of conductive coils.

15. The transducer of claim 1, wherein said panel has a tip end, said frame having a wall aligned with said tip end of said panel, said wall being curved to accommodate movement of said tip end of said panel as said panel rotates.

16. The transducer of claim 1, wherein said panel is trapezoidal-shaped and said frame is trapezoidal-shaped.

17. The transducer of claim 1, wherein said panel is an integral wall of a horn.

18. The transducer of claim 1, wherein said panel directs sound waves generated by another transducer.

19. An electromagnetic transducer, comprising:

a frame;

a panel disposed within said frame and coupled to said frame such that said panel may rotate relative to said frame about a rotational axis at the coupling between said panel and said frame;

a conductive coil coupled to said panel;

a magnetic structure connected to said frame, said magnetic structure including a gap in which a magnetic field is provided, said gap being positioned to receive said conductive coil; and said conductive coil being electrically charged within said gap to move such that said coil moves in a radial path and said panel rotates about said rotational axis to displace air.

20. The electromagnetic transducer of claim 19, wherein said gap is curved and said conductive coil is curved and disposed within said curved gap such that as said panel rotates about said rotational axis, said curved coil moves in a radial path within said curved gap relative to said magnetic structure.

21. The electromagnetic transducer of claim 19, wherein said panel has an inner face and an outer face and said frame is mounted to an enclosure such that, as said panel rotates, said inner face displaces air within said enclosure and said outer face displaces air outside of said enclosure such that sound waves are formed.

22. The electromagnetic transducer of claim 19, further including a former connected to said panel, said conductive coil being connected to said former.

23. The electromagnetic transducer of claim 19, wherein said panel is connected to said frame by a flexible sheet, said flexible sheet being connected to a first end of said panel and to a first side of said frame such that said flexible sheet flexes as said panel rotates.

24. The electromagnetic transducer of claim 19, wherein said panel is coupled to said frame by a bearing such that said panel rotates about said bearing relative to said frame.

25. The electromagnetic transducer of claim 19, wherein said panel is in a first position when said panel is not rotating about said rotational axis, said panel being connected to a spring such that as said panel rotates, said spring resists said rotation of said panel and such that when said panel is not rotating, said spring maintains said panel in said first position.

26. The electromagnetic transducer of claim 19, wherein said panel is in a first position when said panel is not rotating about said rotational axis, said panel including a first magnet and said frame including a second magnet and a third magnet, said first magnet being oriented relative to said second magnet and said third magnet such that as said panel rotates, said first magnet is magnetically repulsed by said second magnet and said third magnet and such that when said panel is not rotating, said magnetic repulsion maintains said panel in said first position.

27. The electromagnetic transducer of claim 19, wherein said panel includes a seal extending toward said frame.

28. The electromagnetic transducer of claim 19, wherein said transducer is combined with at least one other audio transducer to form a speaker system.

29. The electromagnetic transducer of claim 19, wherein said panel has a planar shape.

30. The electromagnetic transducer of claim 19, wherein said magnetic structure includes an inner wall with a first magnet mounted thereto and a center wall with a second magnet mounted thereto, said first and second magnets defining said gap therebetween and providing said magnetic field in said gap, said conductive coil moving within said gap as said panel rotates about said rotational axis.

31. The electromagnetic transducer of claim 19, wherein said magnetic structure includes an inner wall and a center wall with a magnet mounted to said inner wall such that said magnet and said center wall define said gap therebetween and provide said magnetic field in said gap, said conductive coil moving within said gap as said panel rotates about said rotational axis.

32. The electromagnetic transducer of claim 19, wherein said conductive coil is curved and said magnetic structure includes an inner wall and a center wall with a magnet mounted to said inner wall, said magnet being curved with respect to said inner wall and said center wall being curved with respect to said inner wall such that said curved magnet and said curved center wall define said gap therebetween such that said gap is curved and provide said magnetic field in said curved gap, said curved gap receiving said curved conductive coil therein.

33. The electromagnetic transducer of claim 19, wherein said panel has an inner face including a former that is curved with respect to said inner face and said conductive coil being curved with respect to said inner face and being connected to said former, said conductive coil and said former being received within said gap.

34. The electromagnetic transducer of claim 19, wherein said frame has an inner surface, said magnetic structure being mounted to said inner surface of said frame at a non-perpendicular angle such that said gap receives said conductive coil therein.

35. The electromagnetic transducer of claim 19, wherein said panel is curved.

36. The electromagnetic transducer of claim 19, wherein said panel is tapered.

37. The electromagnetic transducer of claim 19, wherein said conductive coil includes a plurality of conductive coils, said plurality of conductive coils being received by said magnetic structure.

38. The electromagnetic transducer of claim 19, wherein said panel has a tip end, said frame having a wall aligned with said tip end of said panel, said wall being curved such that a generally constant distance is maintained between said tip end of said panel and said wall of said frame as said panel rotates.

39. The electromagnetic transducer of claim 19, wherein said panel is trapezoidal-shaped and said frame is trapezoidal-shaped.

40. The electromagnetic transducer of claim 19, wherein said panel is an integral wall of a horn.

41. The electromagnetic transducer of claim 19, wherein said panel of said electromagnetic transducer guides sound waves generated by another transducer.

* * * * *